US006670938B1

(12) United States Patent
Yoshida

(10) Patent No.: US 6,670,938 B1
(45) Date of Patent: Dec. 30, 2003

(54) ELECTRONIC CIRCUIT AND LIQUID CRYSTAL DISPLAY APPARATUS INCLUDING SAME

(75) Inventor: Daisuke Yoshida, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/505,194

(22) Filed: Feb. 16, 2000

(30) Foreign Application Priority Data

Feb. 16, 1999 (JP) ..... 11-037319
Jun. 17, 1999 (JP) ..... 11-171703
Feb. 8, 2000 (JP) ..... 2000-030625

(51) Int. Cl.[7] ..... G09G 3/36
(52) U.S. Cl. ..... 345/98; 345/100
(58) Field of Search ..... 345/96, 87, 98, 345/100, 103, 206, 547, 560; 710/69; 377/64

(56) References Cited

U.S. PATENT DOCUMENTS 4,097,753 A * 6/1978 Cook et al. ..... 327/100
4,454,483 A * 6/1984 Baylor ..... 331/11
5,325,187 A * 6/1994 Kubo et al. ..... 348/692
5,359,342 A * 10/1994 Nakai et al. ..... 345/601
5,591,973 A * 1/1997 Masarik et al. ..... 250/332
5,875,198 A * 2/1999 Satoh ..... 714/738
5,936,602 A * 8/1999 Tsuchida et al. ..... 345/63
6,031,514 A 2/2000 Hashimoto et al. ..... 345/94
6,311,051 B1 * 10/2001 Jung ..... 375/319

* cited by examiner

*Primary Examiner*—Bipin Shalwala
*Assistant Examiner*—Jeff Piziali
(74) *Attorney, Agent, or Firm*—Fitzpatrick, Cella, Harper & Scinto

(57) ABSTRACT

An electronic circuit including a plurality of D/A converters is operated to provide uniform outputs from the D/A converters even if the D/A converters have different levels of offset values by providing each D/A converter with a memory for offset correction digital data and an adder for adding the offset correction digital data to a digital input signal to the D/A converter. The uniformized outputs from the A/D converters may be used for providing a uniform display on a liquid crystal display apparatus. The liquid crystal apparatus may be provided with a pair of common signal lines for separately supplying positive polarity-picture signals and negative-polarity picture signals to an active matrix substrate for driving the liquid crystal.

14 Claims, 20 Drawing Sheets

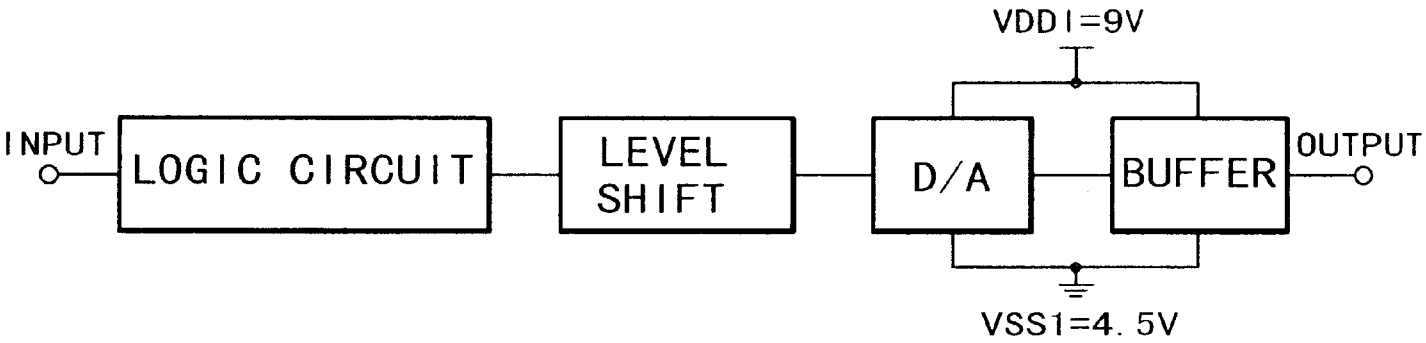
FIG. 16A : POSITIVE-POLARITY PICTURE SIGNAL GENERATOR
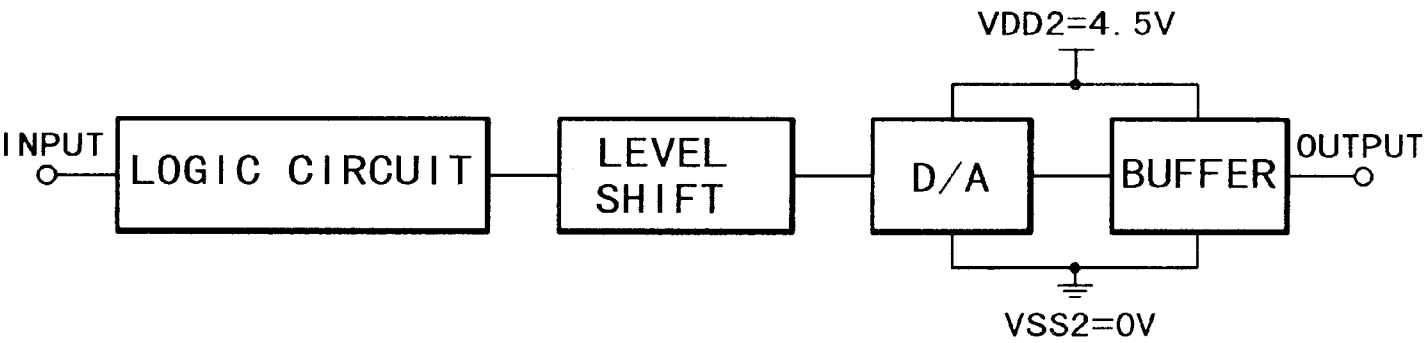
FIG. 16B : NEGATIVE-POLARITY PICTURE SIGNAL GENERATOR

ELECTRONIC CIRCUIT AND LIQUID CRYSTAL DISPLAY APPARATUS INCLUDING SAME

FIELD OF THE INVENTION AND RELATED ART

The present invention relates to an electronic circuit including a plurality of D/A converters and a liquid crystal display apparatus including the electronic circuit. Particularly, the present invention relates to an electronic circuit including a plurality of D/A converters each provided with a means for storing digital data for correcting offset value and an operation means for adding or subtracting the digital data for offset value correction to or from a digital input signal, and also a liquid crystal display apparatus including the electronic circuit.

As a conventional electronic circuit including a plurality of D/A converters, there is one as shown in FIG. 7 composed of only data latch circuits and D/A converters data. FIG. 8 is a block diagram of an example of liquid crystal display apparatus including such an electronic circuit of which plural D/A converters dac are used as means for transferring picture signals to a plurality of vertical data lines.

The above-mentioned conventional circuit has involved drawbacks as follows. More specifically, respective D/A converters have substantial fluctuations of performances, particularly remarkable differences in DC offset values (i.e., DC deviations from objective outputs) from respective amplifiers especially in case of using CMOS amplifiers at output stage analog buffer circuits. A certain vertical data line is always supplied with a signal from one D/A converter, so that the fluctuations of performances of D/A converters are recognized directly as fluctuations of picture display, more specifically as vertical band-like patterns corresponding to respective D/A converters, thus lowering the display quality.

On the other hand, a conventional type of liquid crystal apparatus includes a liquid crystal device comprising an active matrix substrate having thereon a plurality of data liens arranged in columns, a plurality of scanning lines arranged in rows, pixel electrodes each formed at an intersection of the data lines and the scanning lines, and pixel switches each formed at one pixel electrode so as to supply a picture signal to the pixel electrode from an associated data line via the pixel switch, a counter substrate disposed opposite to the active matrix substrate; and a liquid crystal disposed between the active matrix substrate and the counter substrate.

FIG. 18 is an equivalent circuit diagram for an active matrix-type liquid crystal device included in an active matrix-type liquid crystal display apparatus as an example of such a conventional liquid crystal apparatus. Referring to FIG. 18, the liquid crystal display apparatus includes a common signal line 701, vertical signal lines (data lines) 702–705, CMOS-type transfer switches 706–709, pixel switches 710, retention capacitors 711, a liquid crystal 712, a horizontal scanning circuit 713, a vertical scanning circuit 714, and scanning lines 715–718.

In such a liquid crystal display apparatus, it is generally practiced to apply AC signals for driving the liquid crystal so as to prevent the deterioration of the liquid crystal. FIG. 19 is a time-serial waveform chart showing a picture signal for such an AC drive wherein the picture signal is inverted for each cycle period to output both positive and negative polarity signals.

In such AC drive, a picture signal is caused to have a large amplitude on the order of, e.g., 9 volts, which is twice that of a positive or negative one-polarity signal relative to a central voltage. In FIG. 19, a portion of picture signal having a voltage higher than the central voltage is referred to as a positive-polarity signal, and a portion of the picture signal having a voltage lower than the central voltage is referred to as a negative-polarity voltage.

In such a liquid crystal display apparatus, such picture signals are supplied to the common signal line 701, and transfer switches 706–709 are sequentially turned on by the horizontal scanning circuit 713 to transfer the picture signals to the vertical signal lines 702–705 while one of the scanning lines 715–718 is sequentially selected by the vertical scanning circuit 714 to turn on the pixel switches 710 along a row of selected scanning line, thereby supplying the picture signals to the respective pixel electrodes on the row.

Heretofore, CMOS-type switches have been used as the transfer switches 706–709. On the other hand, if an n-channel-type MOS (transistor) switch is used as the transfer switch, the switch-on resistance is increased as the picture signal voltage becomes higher due to a substrate bias effect, so that sufficient signal transfer becomes difficult. Reversely, if a p-channel-type MOS switch is used, the switch-on resistance is increased as the picture signal voltage becomes lower due to the substrate bias effect, so that sufficient signal transfer becomes difficult.

For the above reason, a CMOS-type switch including both an n-channel and a p-channel has been used so as to attain a substantially constant on-resistance over an entire voltage range of picture signal.

On the other hand, regarding the AC drive inversion period, a row inversion, a column inversion or a dot inversion scheme, has been generally adopted. For each inversion in such cases, the polarity of a picture signal is inverted for each desired inversion period with respect to a central voltage as shown in FIG. 19 by a picture signal processing means, and then the picture signal is supplied to the common signal line 701.

Further, accompanying the demand for higher resolution pictures in recent years, the dot rate of picture signal is becoming very fast. Accordingly, a liquid crystal display apparatus as shown in FIG. 20 having two common signal lines 701A and 701B so as to reduce the dot rate to a half, has been also conventionally used. The number of input terminals can be further increased depending on a limiting operation frequency of the drive circuit.

However, even in such a liquid crystal display apparatus using two common signal lines for AC drive, a very high drive voltage on the order of 9 volts is required, thus requiring an increased power consumption. Further, as a result of using CMOS-type switches for the transfer switches, the circuit size has to be enlarged.

SUMMARY OF THE INVENTION

In view of the above-mentioned problems of the prior art, an object of the present invention is to provide an electronic circuit including a plurality of D/A converters and capable of uniformizing the performances of the D/A converters even when there are fluctuations in offset values for the respective D/A converters, by correction of the offset values.

A further object of the present invention is to provide a liquid crystal display apparatus including such an electronic circuit, thereby exhibiting a uniform display characteristic over the entire picture area.

A further object of the present invention is to provide a liquid crystal apparatus capable of operation at a relatively low drive voltage according to an AC drive mode.

According to the present invention, there is provided an electronic circuit, comprising a plurality of first D/A converters, wherein each first D/A converter is provided with:

an offset memory means for memorizing offset correction digital data, and an operation means for adding or subtracting the offset correction digital data to or from a digital input signal to the D/a converter.

According to the present invention, there is further provided a liquid crystal apparatus, comprising:

a liquid crystal device comprising an active matrix substrate having thereon a plurality of signal lines arranged in columns, a plurality of scanning lines arranged in rows, and pixel electrodes each connected via a pixel switch to an intersection of the signal lines and the scanning lines so as to supply picture signals to the pixel electrodes via the signal lines, a counter substrate disposed opposite to the active matrix substrate, and a liquid crystal disposed between the active matrix substrate and the counter substrate, and drive means for driving the liquid crystal devices, wherein said drive means including:

a first common signal line and a second common signal line for supplying the picture signals, picture signal-supplying means for supplying picture signals of one polarity to the first common signal line and picture signals of the other polarity to the second common signal line, a first and a second transfer switch provided to each column signal line for selectively supplying one of picture signals supplied to the first and second common signal lines to each column signal line, and column inversion drive means for:

in a first frame, selectively turning on the first transfer switches for odd-numbered column signal lines and the second transfer switches for even-numbered column signal lines, and in a second frame, selectively turning on the second transfer switches for odd-numbered column signal lines and the first transfer switches for even-numbered column signal lines.

The present invention further provides a liquid crystal apparatus, comprising:

a liquid crystal device comprising an active matrix substrate having thereon a plurality of signal lines arranged in in columns, a plurality of scanning lines arranged rows, and pixel electrodes each connected via a pixel switch to an intersection of the signal lines and the scanning lines so as to supply picture signals to the pixel electrodes via the signal lines, a counter substrate disposed opposite to the active matrix substrate, and a liquid crystal disposed between the active matrix substrate and the counter substrate, and drive means for driving the liquid crystal devices, wherein said drive means including:

a first common signal line and a second common signal line for supplying the picture signals, picture signal-supplying means for supplying picture signals of one polarity to the first common signal line and picture signals of the other polarity to the second common signal line, a first and a second transfer switch provided to each column signal line for selectively supplying one of picture signals supplied to the first and second common signal lines to each column signal line, and dot inversion drive means for:

in a first frame, selectively turning on the first transfer switches for odd-numbered column signal lines and the second transfer switches for even-numbered column signal lines at the time of scanning odd-numbered scanning lines, and selectively turning on the second transfer switches for odd-numbered column signal lines and the first transfer switches for even-numbered column signal lines at the time of scanning even-numbered scanning lines; and in a second frame, selectively turning on the second transfer switches for odd-numbered column signal lines and the first transfer switches for even-numbered column signal lines at the time of scanning odd-numbered scanning lines, and selectively turning on the first transfer switches for odd-numbered column signal lines and the second transfer switches for even-numbered column signal lines at the time of scanning even-numbered scanning lines.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 16A and 16B are block diagrams of positive- and negative-polarity picture signals-generating circuits, respectively, in the signal possessing circuit of FIG. 12.

DESCRIPTION OF THE PREFERRED EMBODIMENTS

Figure 1:
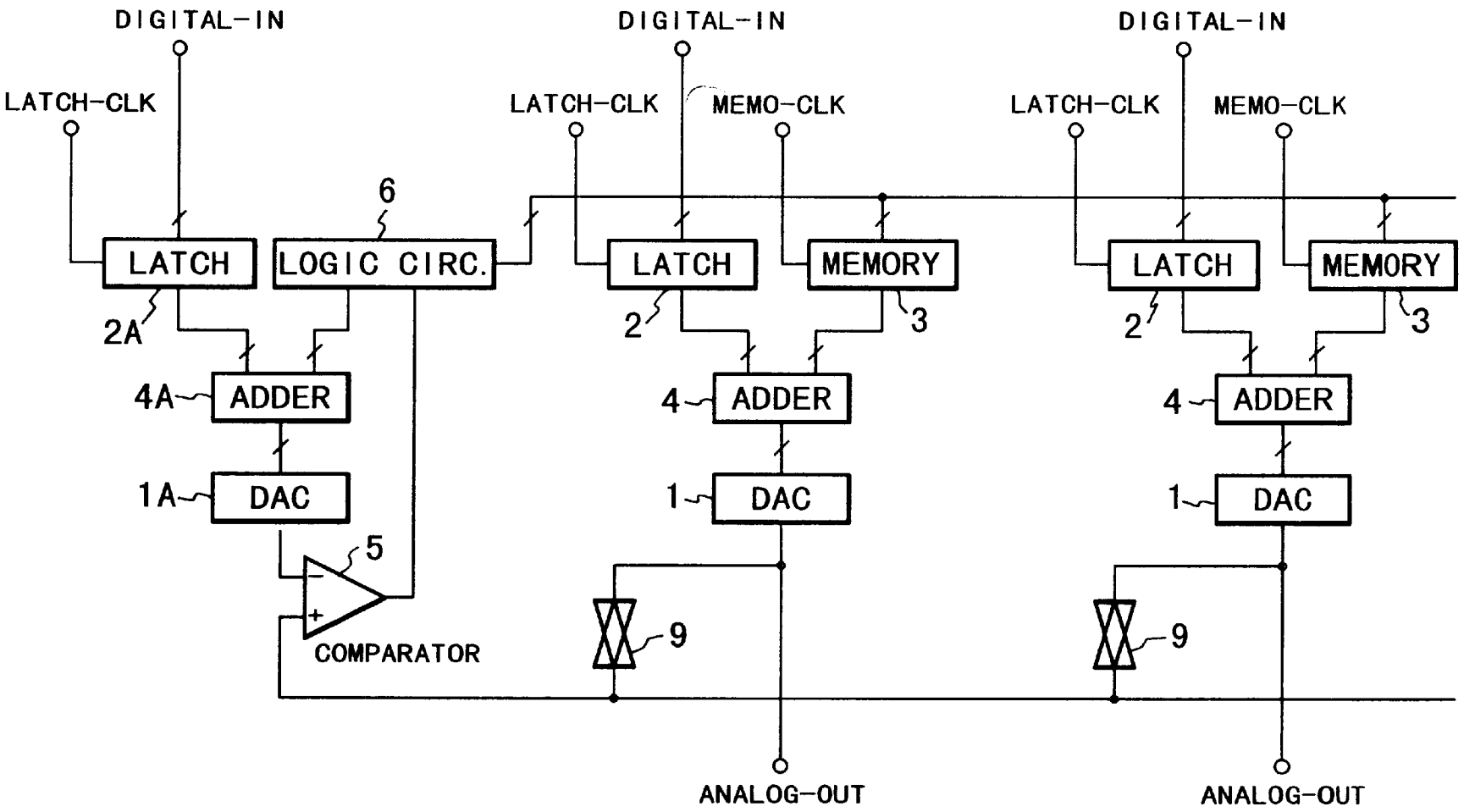
FIG. 1 is a block diagram of an electronic circuit according to an embodiment of the invention.

FIG. 1 is a block diagram of an electronic circuit according to an embodiment of the present invention. Referring to FIG. 1, the electronic circuit includes a plurality of D/A converters 1 arranged in a horizontal direction of the figure. Each D/A converter 1 is provided with a latch circuit 2 for memorizing a digital signal, a memory circuit 3 for memorizing offset correction data, and an adder circuit 4 for adding the offset correction data to the digital signal. Furthermore, a circuit unit (an A/D converter unit) shown on the leftmost side of the figure is a circuit for measuring the offset value for each D/A converter and converting the offset value to digital data, and includes a latch circuit 2A for memorizing a digital signal, a D/A converter 1A for converting digital data to an analog signal, a comparator 5 for comparing an analog output from the D/A converter 1A in the offset value measurement circuit and an analog output from each D/A converter 1 arranged horizontally, and an encoder circuit 6 for generating digital offset correction data based on the output of the comparator 5.

Now, the operation of the electronic circuit shown in FIG. 1 is described. First, digital data of identical level (e.g., binary-coded 8 bit data of (00111100)) is are supplied to the respective data latch circuits 2 and to a latch circuit 2A in the leftmost offset data generating circuit, where the digital data is latched in synchronism with the latch clock ignal (LATCH CLK). At this time, the memory circuits 3 for memorizing respective offset correction data (e.g., of 5 bits) are reset to a prescribed level (e.g., 5 bit data of (10000) as a default). As a result, the respective D/A converters 1 are supplied with digital signals of an identical level, but analog outputs of the respective D/A converters 1 include superposed offset values peculiar to the respective D/A converters 1, so that the analog outputs can be respectively different. Now, switches 9 connected to the D/A converters 1 are sequentially turned on. Then, the analog outputs of the respective D/A converters 1 are compared with the analog output of the D/A converter 1A in the offset correction data-generating D/A converter circuit to measure respective offset values contained in the analog outputs of the respective D/A converters 1 relative to the D/A converter 1A. The measured offset values are sequentially written in the respective memory circuits 3 for the respective D/A converters 1 by the encoder circuit 6.

As a result of the above operation, the data corresponding to the offset value of each D/A converter 1 is memorized in an offset correction memory circuit 3 associated with the D/A converter 1, whereby all the D/A converters 1 are caused to exhibit identical performances thereafter. Incidentally, the latch circuit 2A, the adder 4A and the D/A converter 1A in the leftmost offset value correction circuit (A/D converter unit) are identical in organization as the corresponding circuits 2, 4 and 1 in the other D/A converter circuit units shown on the right side each including a D/A converter 1.

Figure 2:
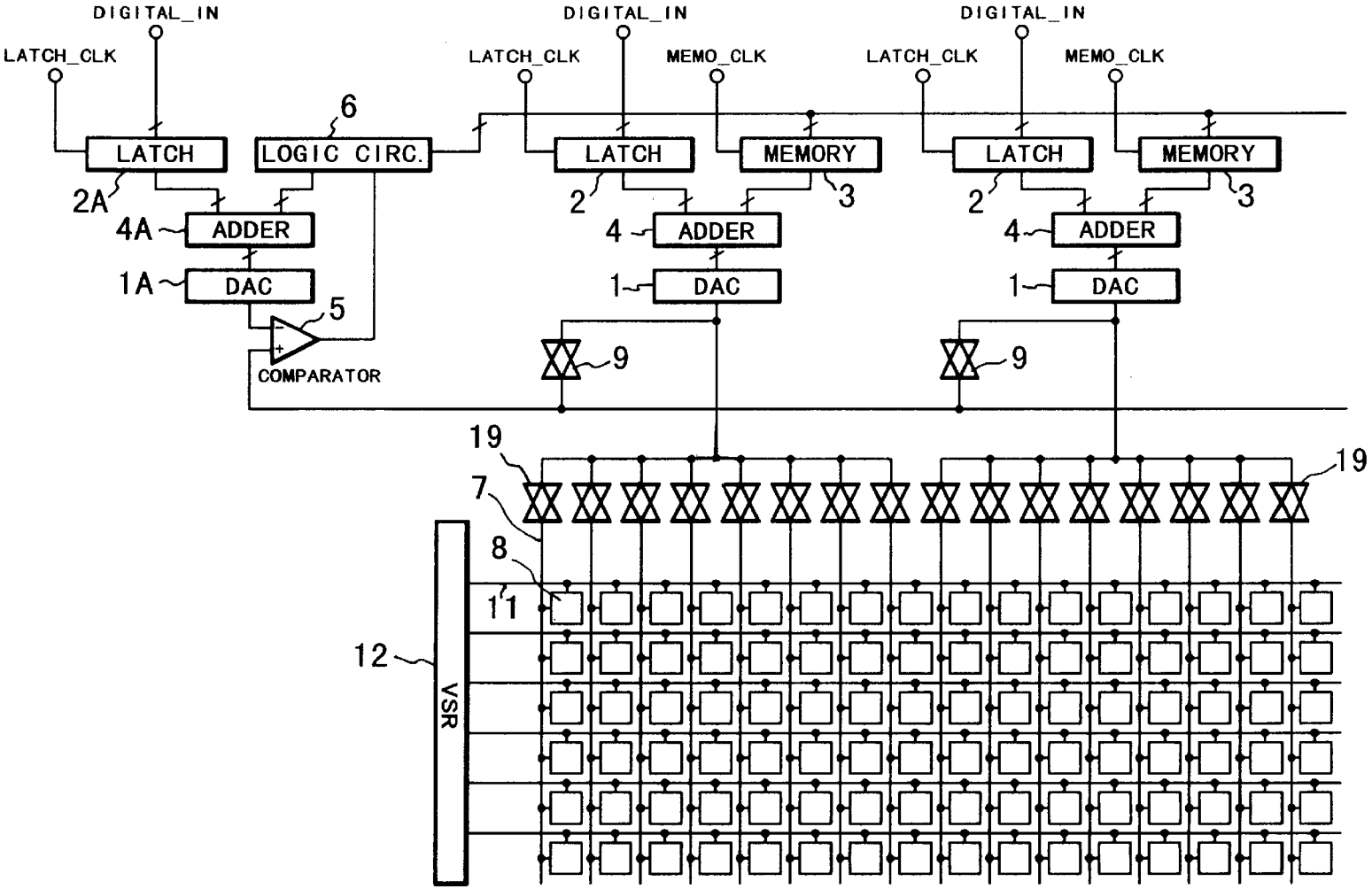
FIG. 2 is a block diagram of a liquid crystal display apparatus including the electronic circuit of FIG. 1.

FIG. 2 is a block diagram of a liquid crystal display apparatus including the electronic circuit of FIG. 1. Referring to FIG. 2, the analog outputs of each D/A converter 1 are supplied to vertical signal lines via signal transfer switches 19 and then to respective pixels 8. Each pixel 8 comprises a pixel transistor, an additional capacitance and a liquid crystal. Scanning lines 11 are sequentially selected depending on an output of a vertical shift register (VSR) 12 to turn on the pixel transistors on each selected scanning line, thereby supplying picture signals (outputs) from the D/A converters 1 to the respective pixels. The above-mentioned offset correction operation may be performed at the time of initial power supply, more preferably at a blanking period for each field operation.

As a result of the above-mentioned offset correction operation, possible fluctuations in performances of the respective D/A converters are corrected, thereby providing a uniform display over the entire picture area of a liquid crystal panel receiving outputs from the respective D/A converters.

Figure 3:
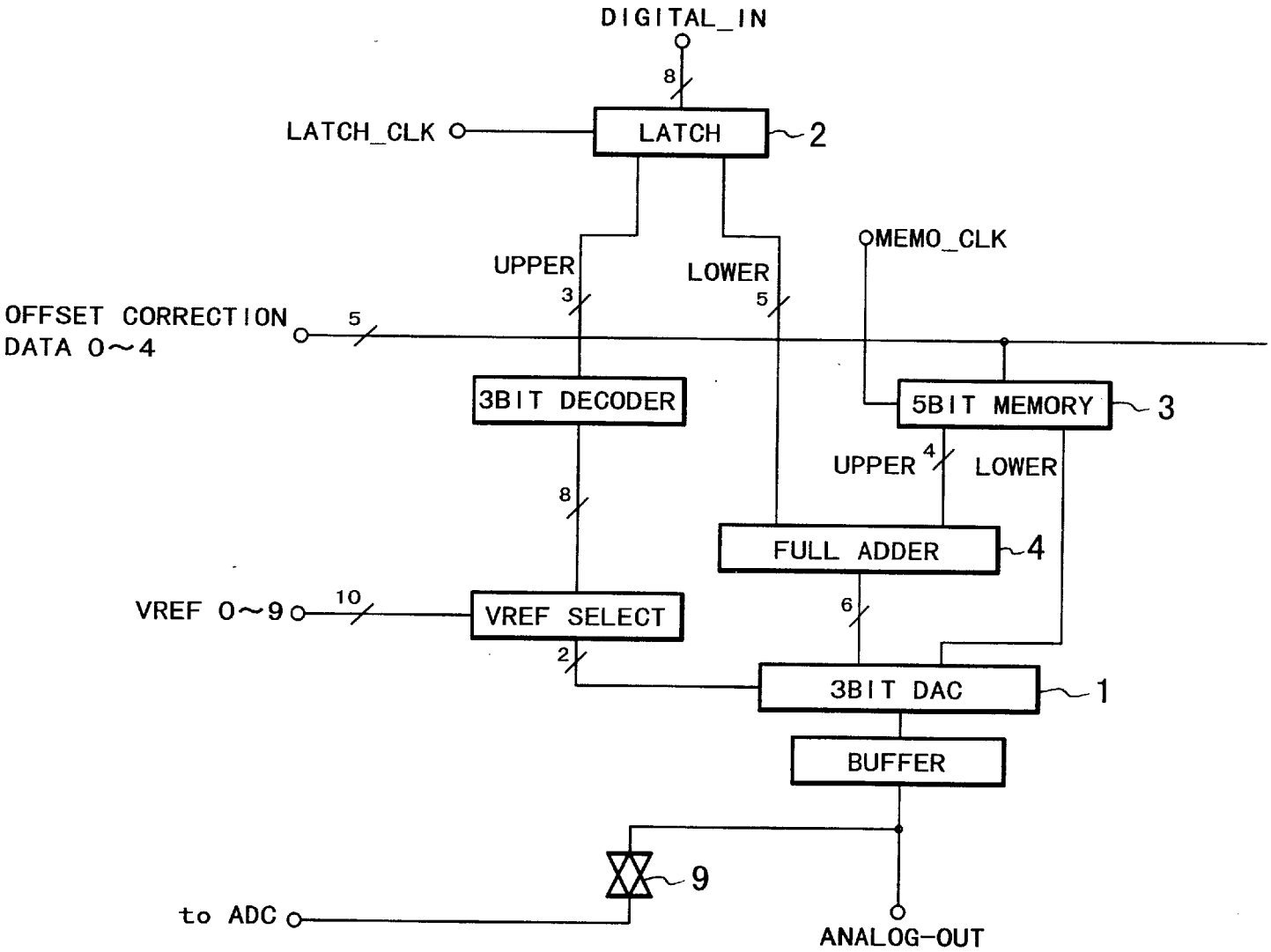
FIG. 3 is a block diagram for each D/A converter unit included in the circuit of FIG. 1.
Figure 4:
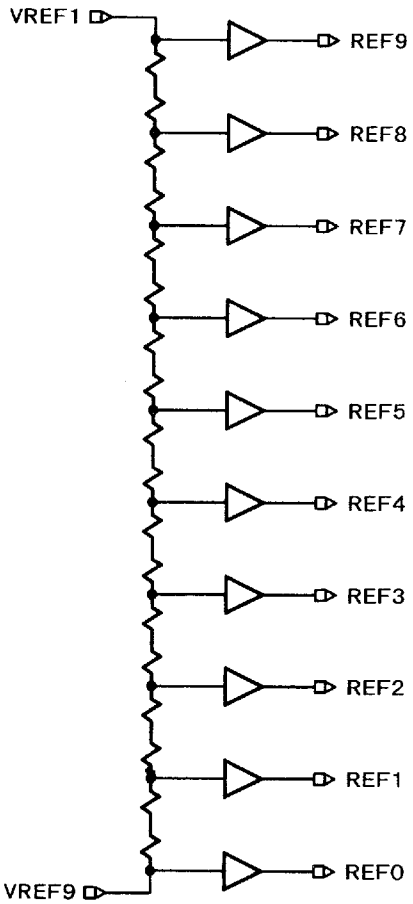
FIGS. 4 and 5 are block diagrams of peripheral circuits for the D/A converter of FIG. 3.
Figure 5:
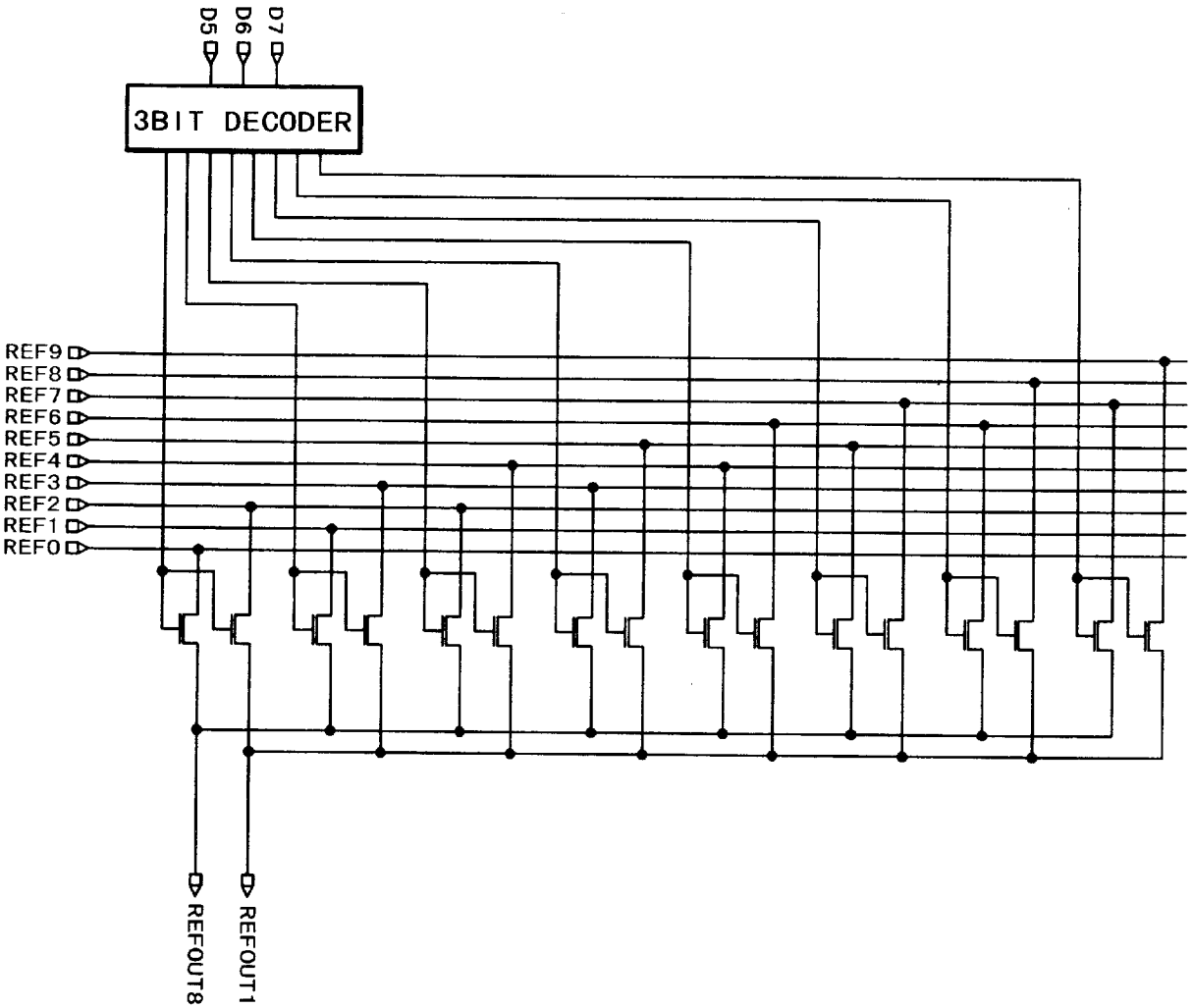

FIG. 3 is a block diagram for each D/A converter circuit including one D/A converter 1 shown in FIG. 1, and FIGS. 4 and 5 are block diagrams for associated peripheral circuits. FIG. 3 illustrates a circuit for processing 8 bit digital input signals (e.g., (00111100)) to effect a D/A conversion operation separately for upper 3 bits (001) and lower 5 bits (11100). In this embodiment, the offset correction can be effected down to a level of ½ LSD (least significant bit) of the digital input signal.

The circuit of FIG. 4 generates 10 levels reference voltages (REF0–REF9) by series resistance division and a buffer circuit.

The circuit of FIG. 5 decodes upper 3 bits (001) of each digital signal to select two (REF1 and REF3) by skipping an intervening one (REF2) of the 10 reference voltages (RER0–REF9). More specifically, FIG. 5 shows details of a block including 3BIT-DECODER and VREF SELECT in FIG. 3, and the selected two reference voltages REF1 and REF3 are inputted to the 7-bit D/A converter 1 as reference voltages. As a result, in the 7-bit D/A converter 1, an output analog signal is determined in the range between REF1 and REF3. As mentioned above, two reference voltages (REF1 and REF3) are determined based on the upper 3 bits of the digital input signal ((001) dictating a second lowest pair in this embodiment), and the analog output range of the 7-bit D/A converter 1 is determined as a range between the two reference voltages.

Figure 22:
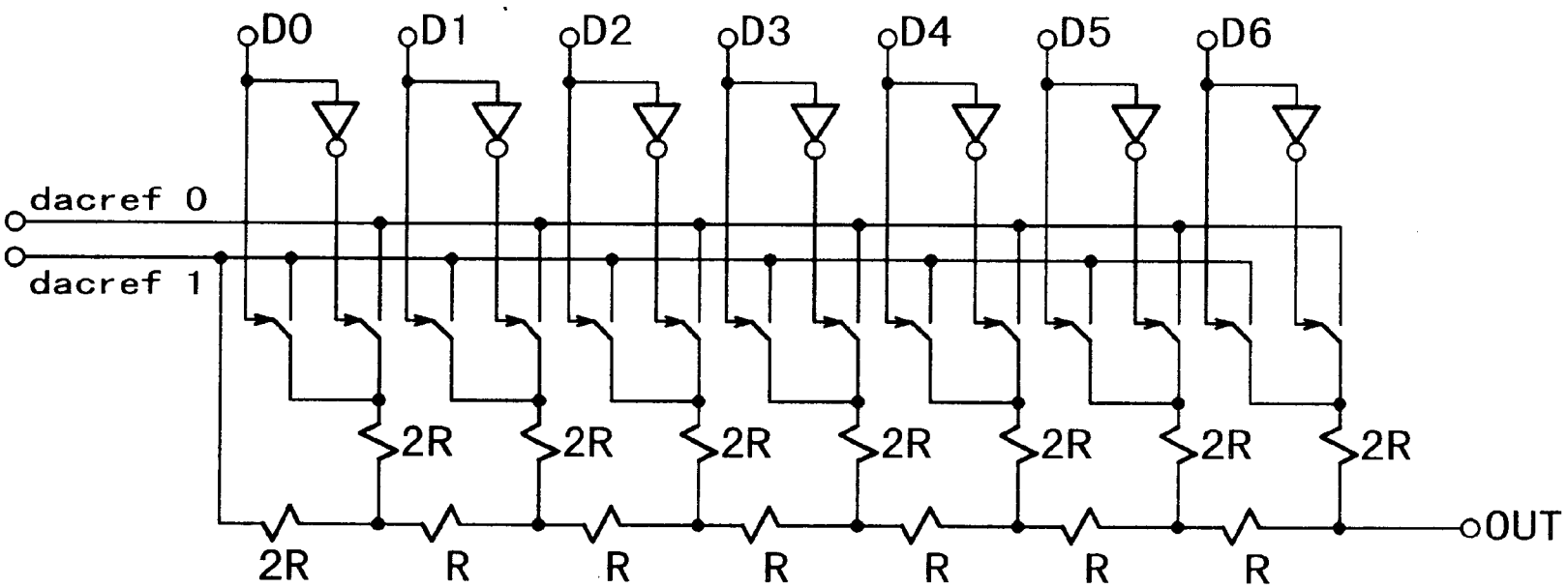
FIG. 22 is a circuit diagram of an example of 7-bit D/A converter usable in the invention.

FIG. 22 is a circuit diagram of an example of 7-bit D/A converter applicable to the present invention. The D/A converter shown in FIG. 22 is generally called a voltage addition resistance ladder-type D/A converter, and R and 2R represent resistances. D0(LSB)–D6(MSB) represent input terminals for digital signals. The two reference voltages REF1 and REF3 are inputted through terminals dcaref 0 and dcaref 1, and an analog output therebetween is outputted from a terminal "out" depending on the digital signal inputted to the 7-bit D/A converter 1.

Then, again referring to FIG. 3, the lower 5 bits (11100) of each digital input signal are added with upper 4 bits (1000) of a 5 bit offset correction signal by a full adder 4 to generate a 6 bit data (100100). The 6 bit data (100100) from the adder 4 is inputted to upper 6 bits (D1–D6 of FIG. 22) of the 7 bit D/A converter 1, and the lowest one (0) of the offset correction signal stored in the 5-bit memory 3 is inputted to the lowest one bit (D0 of FIG. 22) of the 7 bit D/A converter 1.

The analog signal outputted from the D/A converter 1 is converted into a signal with a sufficiently low impedance by a "BUFFER" circuit (shown in FIG. 3, ordinarily an amplifier of gain=1) to provide an analog output signal ANALOG-OUT, which is also supplied through a switch 9 to a comparator 5 of the leftmost correction circuit (which will be described further with reference to FIG. 6).

In the above-described operation, the analog output signal can be accompanied with DC offset due to fluctuations in characteristics of devices such as resistors and transistors included in analog circuits of a D/A converter block including the 7-bit D/A converter 1 and "BUFFER". It is very awkward if the DC offset values are different among a plurality of D/A converters 1 disposed in parallel.

Referring again to FIG. 1, the analog output signal ANALOG-OUT from the D/A converter block is also supplied through a selected one of the switches 9 to the comparator 5 in the correction circuit. The selection (turning-on) of one switch 9 is made so as to connect, one D/A converter block of which the DC offset is to be corrected, if any, to the comparator 5.

Now, a method of generating offset correction data is described with reference to FIG. 6, which is a detailed block diagram of the offset correction data-generating circuit (A/D converter unit) shown on the leftward side of the electronic circuit shown in FIG. 1. Referring to FIG. 6, an analog signal outputted from the D/A converter 1 through the switch 9 (FIG. 1) is inputted through a terminal "FROM DAC1". As mentioned above, the input digital data (00111100) is stored also in the latch circuit 1A. A 5-bit data outputted from a comparative data generating circuit 6B (retaining 5-bit data of (10000) as a default similarly as the 5-bit memory 3 in FIG. 1) is added to the digital data to provide a digital sum, corresponding to which analog data is outputted from "BUFFER". The analog data is compared with the analog data from a D/A converter 1 (in FIG. 1) by a comparator 5. In an ideal case where the analog circuits of both a selected one D/A converter block and the correction circuit (A/D converter unit shown on the leftmost side of FIG. 1 and shown in further detail in FIG. 6) are free from offset, the two analog input values inputted to the comparator 5 should be identical to each other if the comparative data generation circuit 6B outputs 5-bit data (10000) as the same 5-bit data (10000) is stored in the 5-bit memory circuit 3 in FIG. 3 (a somewhat detailed view of one D/A converter block in FIG. 1). Actually, however, there are performance fluctuations in the analog circuits, so that the two analog values are usually not identical to each other. A principal function of the correction circuit shown in FIG. 6 is to sequentially change the comparative data generating circuit 6B until the two analog values coincides with each other. An A/D converter system based on successive comparison may preferably be used for achieving the function.

More specifically, first "high" is set at the highest bit in the comparative data generating circuit 6B to output binary-coded 5-bit data. Then, if the comparator 5 in this case generates an output of "high" (meaning that the analog data from the D/A converter 1 block is higher), the comparative data generating circuit 6B sets "high" at the second highest bit to output (11000) while fixing the highest bit at "high", on receiving the result from the comparator 5. Then, if the comparator 5 in this case generates an output of "low" (meaning that the analog data from the D/A converter 1 block is lower), the comparative data generating circuit 6B sets "low" at the second highest bit and sets "high" at the third highest bit to generate data (10100). This sequential operation is continued down to the lowest bit to detect a difference between the two analog values as a 5-bit digital data. The difference data is then subjected to bit inversion by an encoder circuit 6A to output correction data. (Incidentally, in FIG. 1, the encoder 6A and the circuit 6B in FIG. 6 are represented by a logic circuit 6. ) The relationship therebetween are as follows.

| Difference data | Correction data |
|---|---|
| (00000) | (11111) |
| (00001) | (11110) |
| (00010) | (11101) |
| (00011) | (11100) |
| . | . |
| . | . |
| . | . |
| (11111) | (00000) |

In this embodiment, the lowest bit of the offset correction data is directly inputted to the lowest bit of the 7 bit D/A converter. As a result, the offset correction data can be generated at a resolution down to ½ LSB with respect to inputted 8-bit digital signal. The thus-generated correction data is inputted to and stored at the 5-bit memory circuit 3 (FIG. 3, FIG. 1).

The above operation is repeated for the respective D/A converter blocks, and the correction data inherent to each block is stored in the 5-bit memory circuit 3 of the block, whereby analog outputs from the respective D/A converter blocks are reduced in fluctuation.

Figure 6:
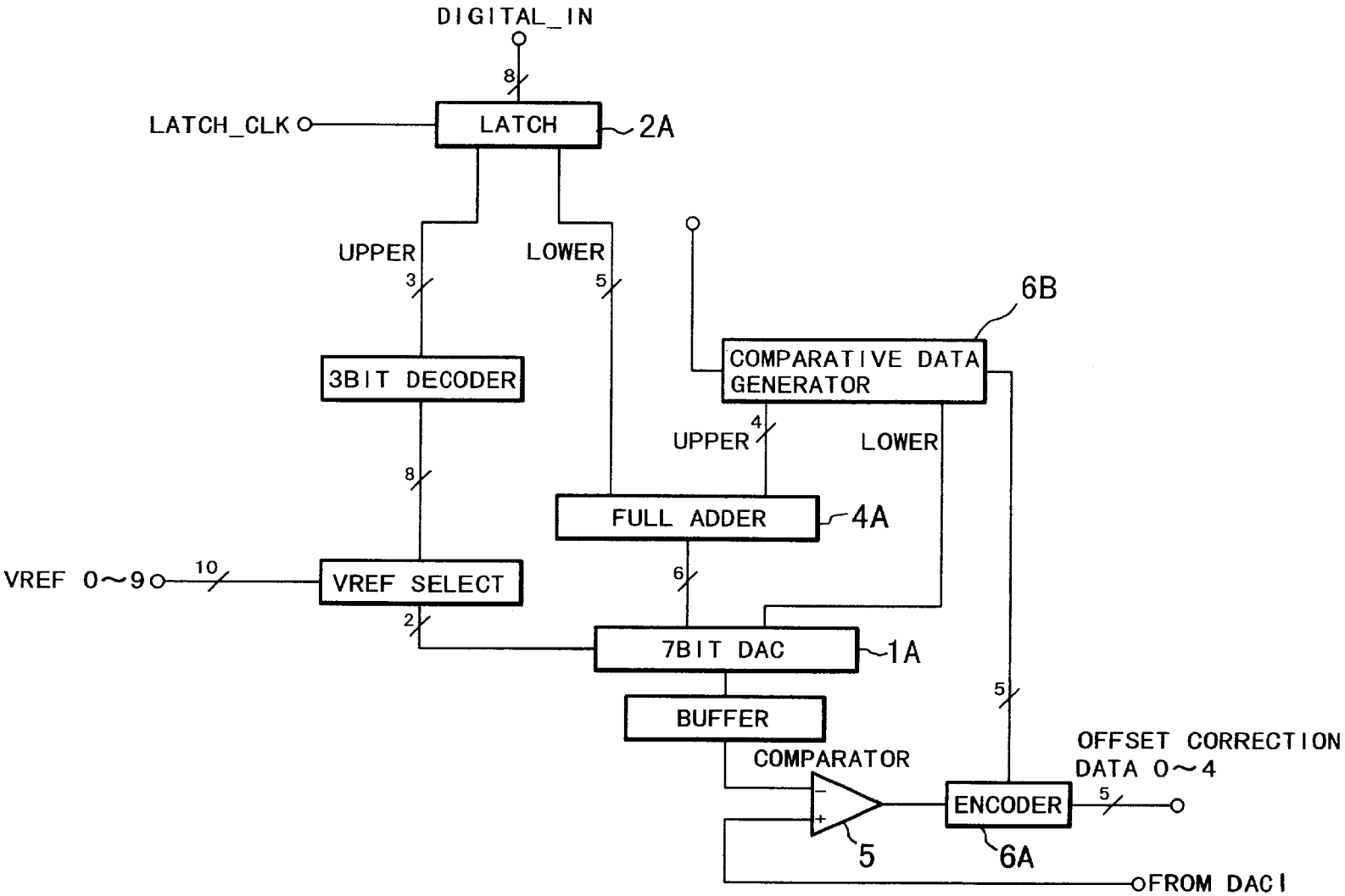
FIG. 6 is a detailed block diagram of an A/D converter (an offset correction data-generating A/D converter unit) shown on the left side of FIG. 1.
Figure 7:
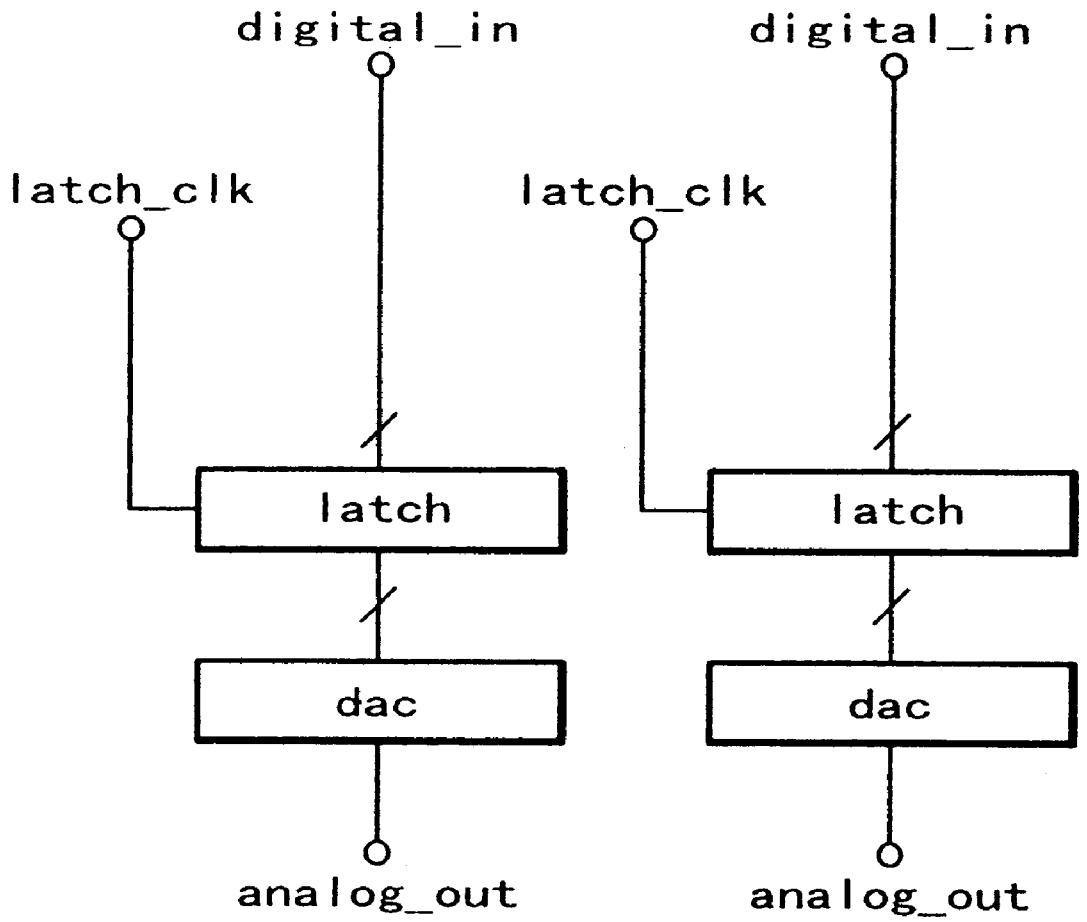
FIG. 7 PRIOR ART
FIG. 7 is a block diagram of a conventional signal supply circuit including a plurality of D/A converters.
Figure 8:
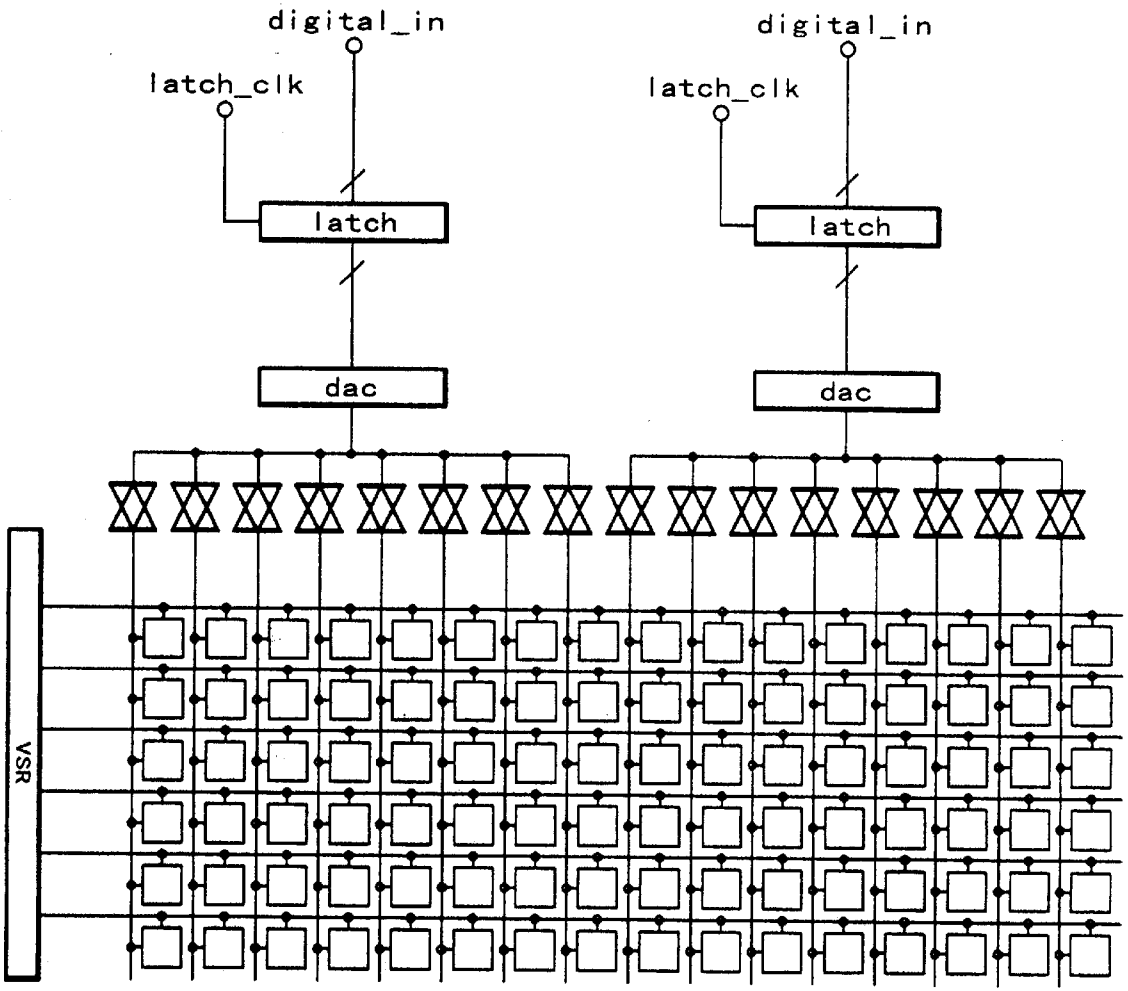
FIG. 8 PRIOR ART
FIG. 8 is a block diagram of a liquid crystal display apparatus including the circuit of FIG. 7.

In this embodiment, at the time of addition of offset correction data and a digital signal, lower 5 bits of the digital signal and upper 4 bits of the offset correction data (FIG. 3, FIG. 6). This is because a large logic circuit is required for addition to an 8-bit digital signal, and an addition circuit for only the lower 5-bit is used. This is allowed by selection of two reference voltages not of adjacent two levels but of non-adjacent two levels by skipping an intervening one. More specifically, even if the addition of the offset correction data and the digital signal requires a vary to the upper 3 bits, the carry can be absorbed without changing the upper 3 bits as there is an overlapping of successively selected reference voltage ranges. As a result, it becomes possible to effect an offset correction without adding to the upper 3 bits. In this embodiment, a correction data has 5 bits, of which upper 4 bits are added. For designing a broader range of correction, it is necessary to broaden the overlapping between successive reference voltage ranges determined by the upper 3 bits of a digital signal. On the other hand, a higher resolution of correction, may be performed by increasing the number of lowest bits of offset correction data directly inputted to the D/A converter from 1 in the above embodiment. This requires a D/A converter of a higher resolution. Such modifications can be arbitrarily made by a system designer depending on the required performances of the electronic circuit under consideration.

In the above, an embodiment of the electronic circuit of the present invention has been described as a means for supplying drive signals to a liquid crystal display apparatus, but the electronic circuit of the present invention can be also applied to another signal processing circuit, such as an audio signal processor and other picture signal processors.

As described above, according to the electronic circuit of the present invention, possible offset value fluctuations of plural D/A converters disposed in parallel can be respectively corrected, so that all the D/A converters are allowed to exhibit identical output performances, so that it becomes possible to uniformize the output of a signal processing apparatus receiving signals from the D/A converters, e.g., to uniformize the display state of a liquid crystal display apparatus.

Figure 9:
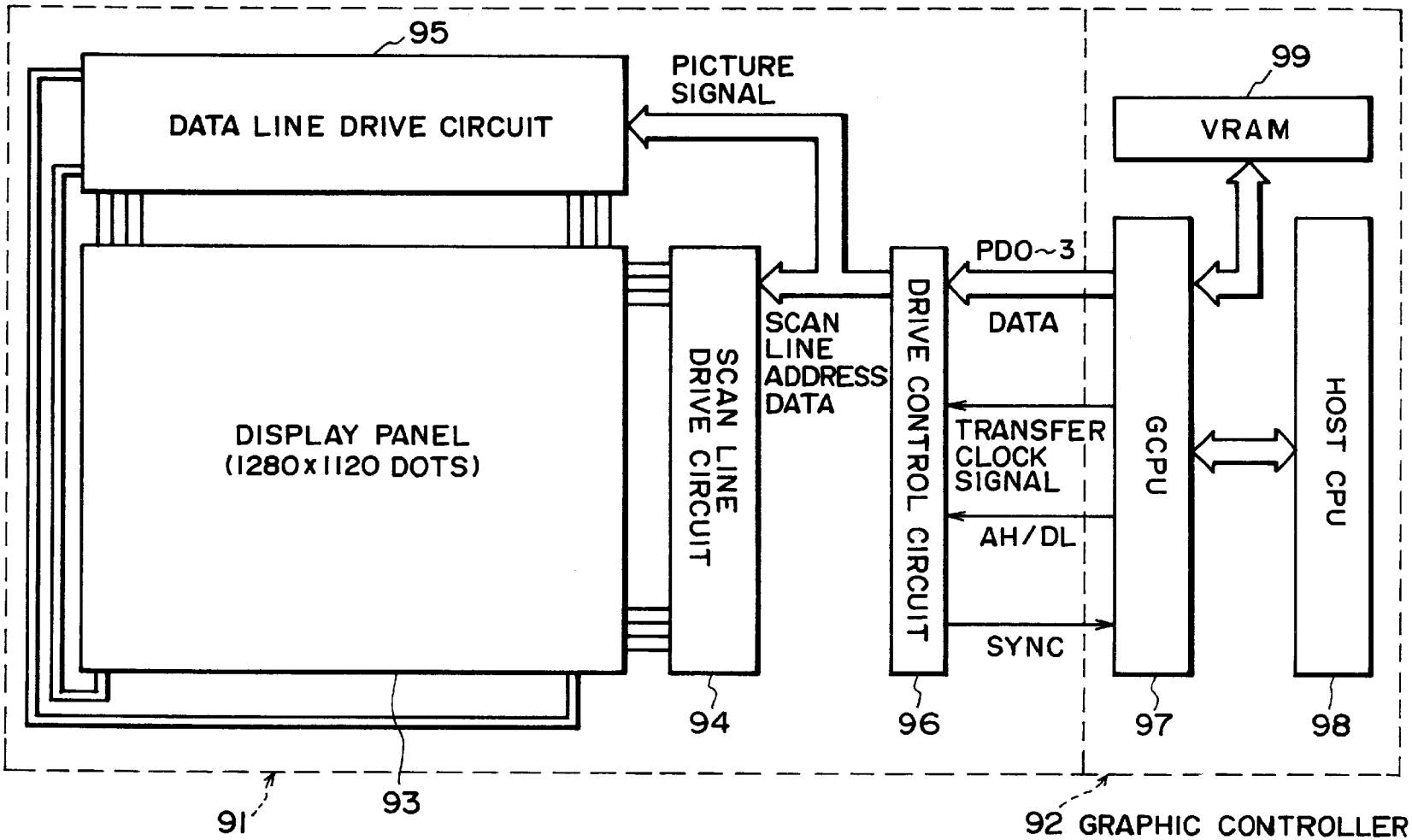
FIG. 9 is a block diagram of a liquid crystal display apparatus according to an embodiment of the invention.

FIG. 9 is a block diagram of an embodiment of the liquid crystal display apparatus according to the present invention. Referring to FIG. 9, a liquid crystal display system includes a liquid crystal display apparatus 91 and a graphic controller 92. The liquid crystal display apparatus 91 includes a display panel 93, a scanning line drive circuit 94, a data line drive circuit 95 and a drive control circuit 96. The graphic controller 92 includes a GCPU (general central processing unit) 97, a host CPU 98 and VRAM (video data storage memory) 99.

The graphic controller 92 is in charge of management and communication of picture or video data between the host CPU 98 and the liquid crystal display apparatus 91. Picture data from the graphic controller 92 is transferred according to a transfer clock signal to the drive control circuit 96 and then transferred as picture signals to the data line drive circuit 95 and scanning line address data to the scanning line drive circuit 94.

Figure 10:
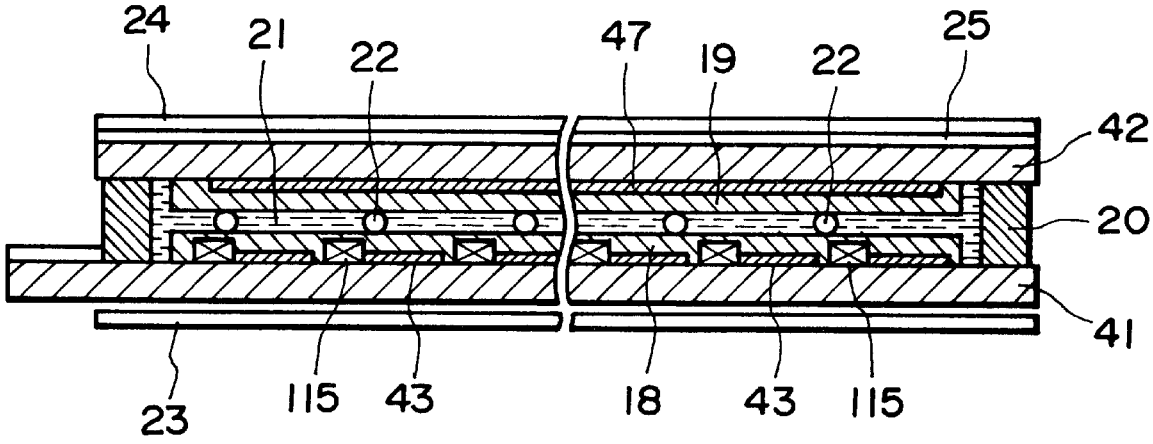
FIG. 10 is a sectional view of a liquid crystal device constituting a display panel in the display apparatus of FIG. 9.

FIG. 10 is a sectional view of a liquid crystal device constituting the display panel 93 in FIG. 9. Referring to FIG. 10, the liquid crystal device incudes a pair of transparent substrates 41 and 42 (of, e.g., glass sheet). The lower substrate 41 is provided with a matrix of transparent pixel electrodes 43 and pixel switches 115 each connected one pixel electrode 43. In this embodiment, the transparent substrates 41 and 42 are insulating substrates and can also comprise a single crystal substrate as a preferred example.

The upper substrate 42 is provided with transparent counter electrode 47 disposed opposite to the pixel electrodes 43 on the lower substrate 41. The substrates 41 and 42 are further coated with alignment control films 18 and 19 and affixed to each other with a sealing member 20 and spacers 22 so as to leave a gap therebetween to be filled with a liquid crystal 21. A cell structure thus formed is sandwiched between a pair of polarizers 23 and 24 to provide a liquid crystal device.

Figure 11:
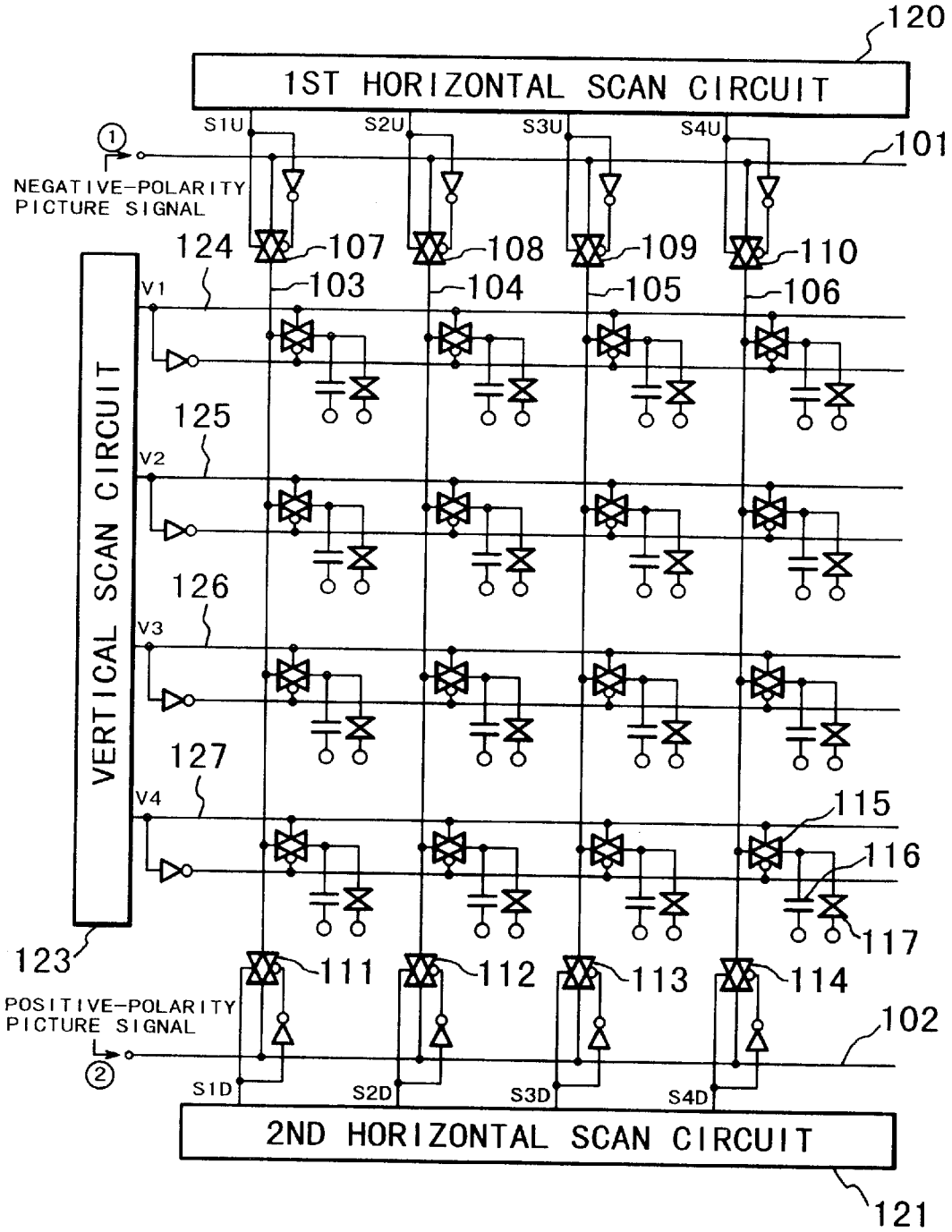
FIG. 11 is an equivalent circuit diagram of a display panel included in the display apparatus of FIG. 9.

FIG. 11 is an equivalent circuit diagram of the display panel 93. Referring to FIG. 11, the display panel includes a first common signal line 101, a second common signal line 102, vertical signal lines (data lines) 103–106, horizontal signal lines (scanning lines) 124–127, first transfer switches 107–110, second transfer switches 111–114, pixel switches 115, holding capacitances 116, and a liquid crystal 116.

The display panel further includes first and second horizontal scanning circuits 120 and 121 disposed on the lower substrate (i.e., active matrix substrate) for supplying picture signals to the first and second common signal lines 101 and 102, respectively, and a vertical scanning circuit 123 also disposed on the lower substrate for supplying a scanning signal to the scanning lines 124–127.

The vertical signal lines 103–106 are connected to both the first and second common signal lines 101 and 102 disposed on both sides via the first transfer switches 107–110 and the second transfer switches 111–114, respectively. The first common signal line 101 is supplied with negative-polarity picture signals from the first horizontal scanning circuit 120, and the second common signal line 102 is supplied with positive-polarity picture signals from the second horizontal scanning circuit 121.

Figure 12:
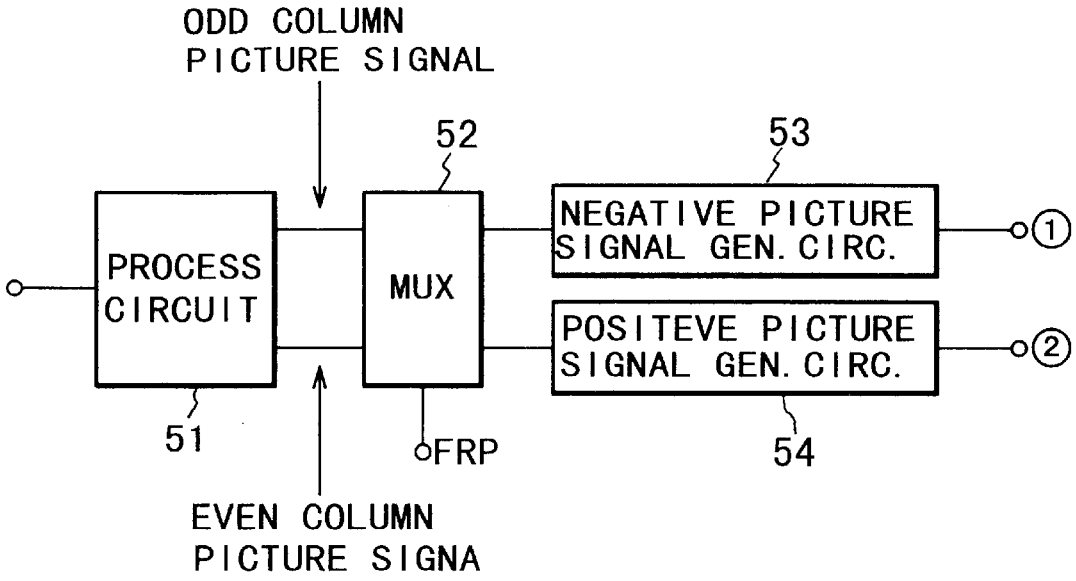
FIG. 12 is a block diagram of a signal processing circuit for supplying negative-polarity and positive-polarity picture signals in the display apparatus of FIG. 9.

FIG. 12 is a block diagram of a signal processing circuit disposed on the lower substrate as a picture signal supply means for supplying negative-polarity picture signals to the first common signal line 101 via the first horizontal scanning circuit 120 and positive-polarity picture signals to the second common signal line 102 via the second horizontal scanning circuit 121.

In the signal processing circuit, picture signals inputted to the data line drive circuit 95 (FIG. 9) are separated by a process circuit 51 into picture signals for odd-numbered column lines (data lines) and picture signals for even-numbered column lines (data lines), which are then supplied via a multiplexer 52 to a negative-polarity picture signal-generating circuit 53 (first picture signal-generating means) for generating negative-polarity picture signals and a positive-polarity picture signal-generating circuit 54 (second picture signal- generating means) for generating positive-polarity picture signals, where the picture signals are subjected to conversion into amplitudes adapted to electrooptical characteristics of the liquid crystal and polarity inversion.

Figure 13:
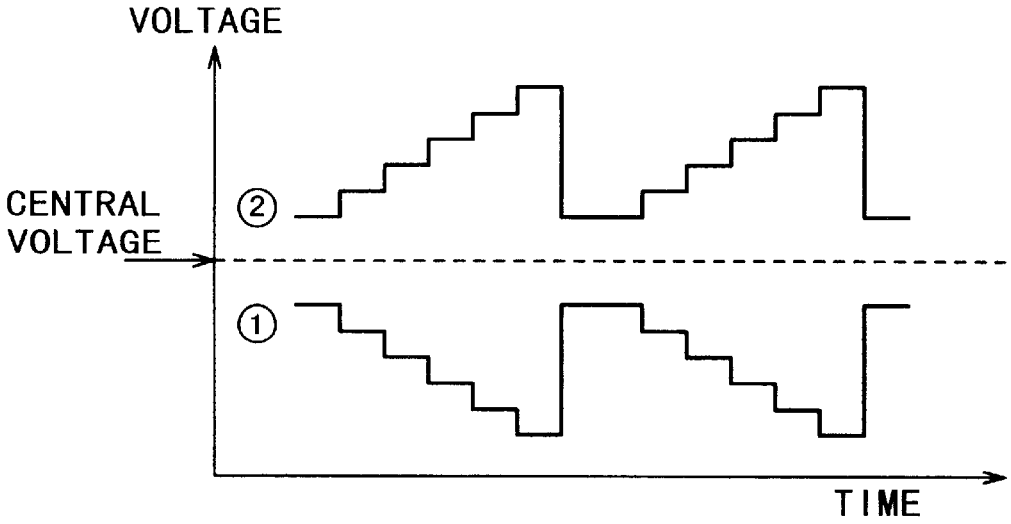
FIG. 13 illustrates negative- and positive-polarity picture signals outputted by the circuit of FIG. 12.

The multiplexer 52 switches addresses of the odd-numbered column picture signals and even-numbered column picture signals for each prescribed period (one frame in this embodiment), whereby the first common signal line 101 is continuously supplied with negative-polarity picture signals as shown at ① of FIG. 13, and the second common signal line 102 is continuously supplied with positive-polarity picture signals as shown at ② of FIG. 13.

The circuit of FIG. 11 further includes switches S1U–S4U for controlling the conduction states of the first transfer switches 107–111 and switches S1D–S4D for controlling the conduction states of the second transfer switches 111–114.

These switches S1U–S4U and S1D–S4D are selectively turned on or off depending on the above-mentioned switching period of the multiplexer 52 to change the selection order of the first transfer switches 107–110 and the second transfer switches 111–114.

Figure 14A:
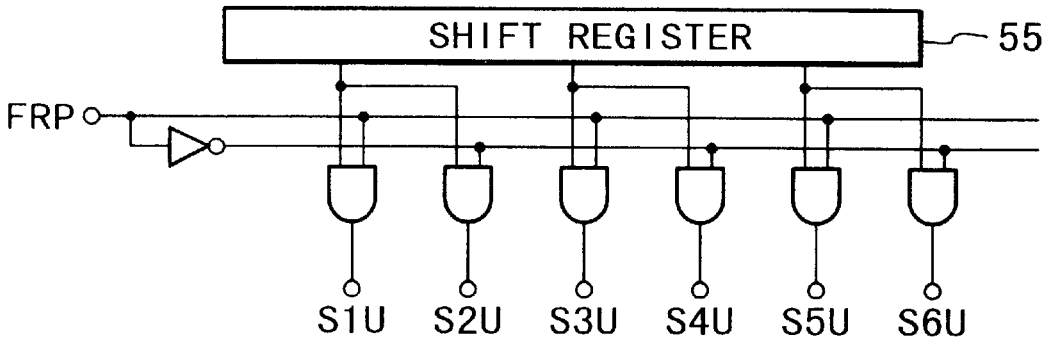
FIGS. 14A and 14B are circuit diagrams of column inversion drive control means provided to the first and second horizontal scanning circuits in the panel of FIG. 11.
Figure 14B:
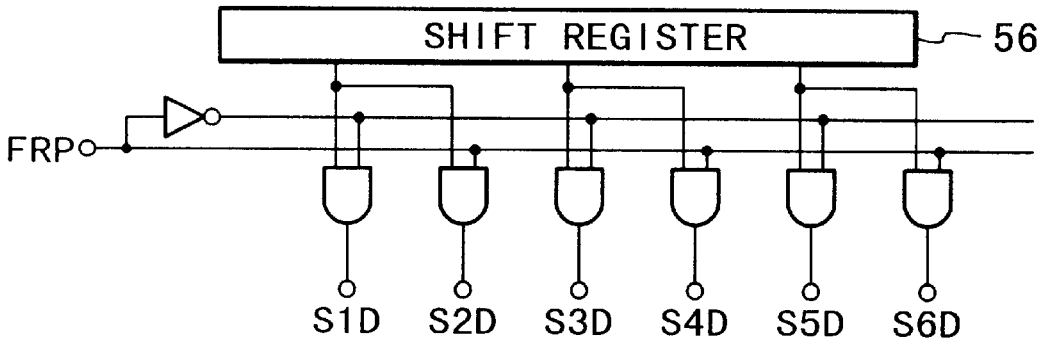

FIGS. 14A and 14B are circuit diagrams of column inversion drive control means provided to the horizontal scanning circuits 120 and 121, respectively, which control the ON and OFF of respective switches S1U–S6U and S1D–S6D to control the conduction states of the first transfer switches 107–110 and the second transfer switches 111–114.

Figure 15:
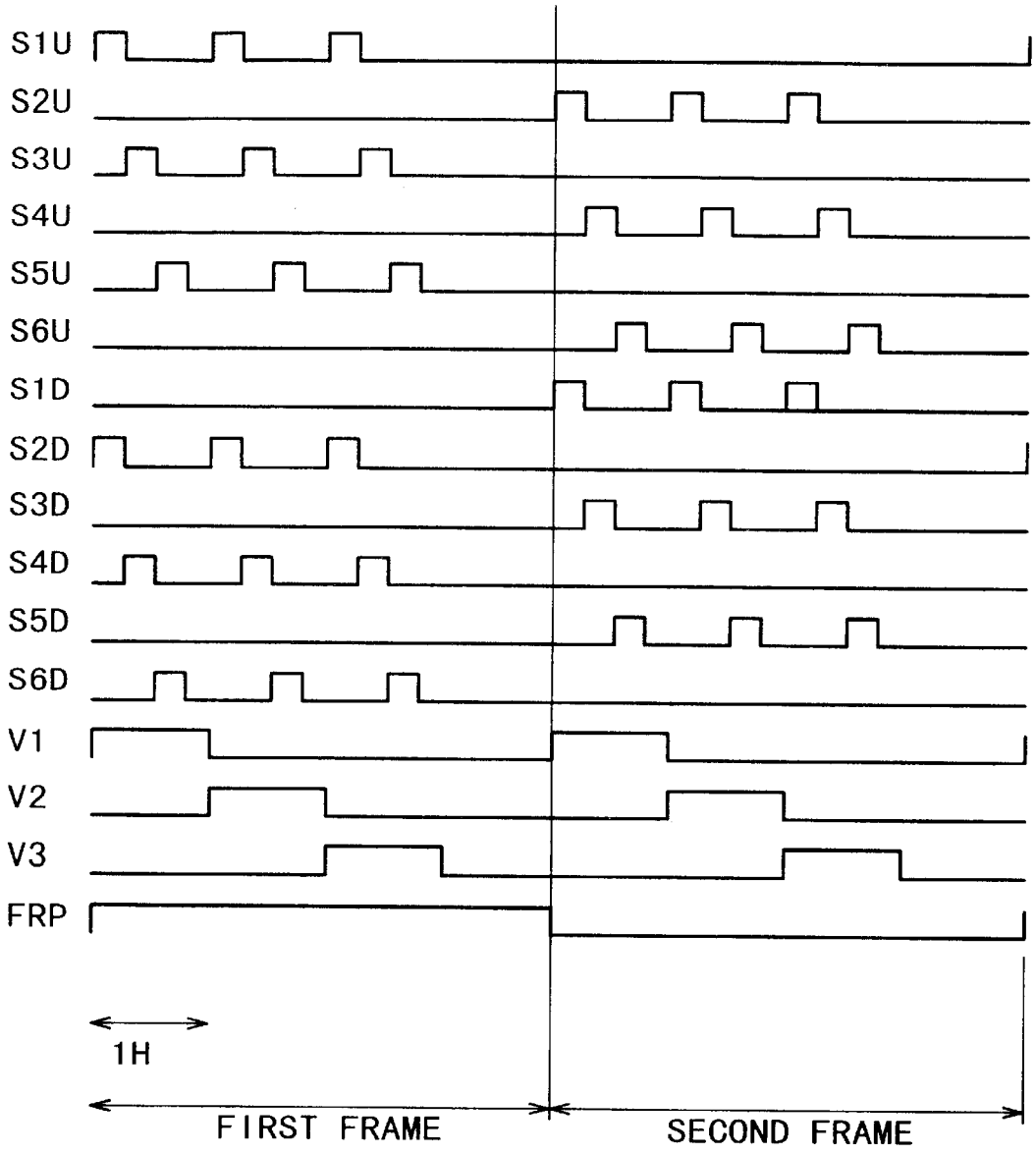
FIG. 15 is a waveform diagram for illustrating a frame-inversion and column-inversion drive of the panel of FIG. 11.

More specifically, in the column inversion drive control means, as shown in FIGS. 14A and 14B, outputs of shift registers 55 and 56 are inputted to AND gates, and as shown in FIG. 15, are sequentially outputted to odd-numbered switches S1U, S3U and S5U among the switches S1U–S6U and even-number switches S2D, S4D and S6D among the switches S1D–S6D, when signal FRP is "high".

On the other hand, when the signal FRP is "low", the outputs of the shift registers 55 and 56 are outputted to even-numbered switches S2U, S4U and S6U among the switches S1U–S6U and odd-number switches S1D, S3D and S4D among the switches S1D–S6D. As a result, individual signal transfer to pixels along odd-numbered columns and even-numbered columns becomes possible.

Then, a column inversion drive operation of the thus-organized liquid crystal display apparatus is described.

As shown in FIG. 15, in a first frame, odd-numbered switches S1U, S3U and S5U, for example, are sequentially selected among the switches S1U–S6U, whereby first transfer switches 107, 109, . . . corresponding to the switches S1U, S3U . . . (FIG. 11) are made conductive so that negative-polarity picture signals are supplied from the first common signal line 101 to pixel electrodes along odd-numbered columns (FIG. 11).

Simultaneously with the above, even-numbered switches among the switches S1D–S6D are sequentially selected, whereby second transfer switches 112, 114, . . . corresponding to the switches S2D, S4D, . . . (FIG. 11) are made conductive, so that positive-polarity picture signals are supplied from the second common signal line 102 to pixel electrodes along even-numbered columns.

The above operations are similarly performed each time when the scanning lines 124–127 are sequentially selected by scanning pulses V1, V2, V3, . . . , thereby completing first frame signal transfer.

Then, in a second frame, even-numbered switches S2U, S4U and S6U among switches S1U–S6U are sequentially selected to supply negative-polarity picture signals to pixel electrodes along even-numbered columns, and also odd-numbered switches S1D, S3D and S5D among switches S1D–S6D are sequentially selected to supply positive polarity picture signals to pixel electrodes along odd-numbered columns. The above operations are similarly repeated each time when the scanning lines 124–127 are sequentially selected by scanning pulses V1, V2, V3, . . . , thereby completing second frame signal transfer.

In a similar manner as described above, in this embodiment, negative-polarity picture signals are supplied to pixels along odd-numbered columns and positive-polarity picture signals are supplied to pixels along even-numbered columns in a first frame, and positive-polarity picture signals are supplied to pixels along odd-numbered columns and negative-polarity picture signals are supplied to pixels along even-numbered columns in a second frame, whereby a frame-inversion and column-inversion drive is realized.

FIGS. 16A and 16B are block diagrams of a positive-polarity picture signal-generating circuit 54 and a negative-polarity picture signal-generating circuit 53 (FIG. 12), in the case where digital picture signals are D/A-converted to output analog signals.

As mentioned above, the negative-polarity picture signal-generating circuit 53 and the positive-polarity picture signal-generating circuit 54 are designed to separately generate negative-polarity picture signals and positive-polarity picture signals. Accordingly, compared wit a conventional picture signal-generating circuit required to generate picture signals having an amplitude on the order of 9 volts for AC drive of liquid crystal, each of the negative-polarity picture signal-generating circuit 53 and the positive polarity picture signal-generating circuit 54 is required to generate picture signal having an amplitude on the order of only 4.5 volts.

In the analog processing circuit unit, supply voltages of the negative-polarity picture signal-generating circuit 5 include a central voltage+$\alpha$ volt ($0 \leqq \alpha \leqq 1$, $\alpha$ being generally set so as to compensate for a lowering of output voltage resistance in the analog processing circuit) and a lowest voltage−$\alpha$ volt, and supply voltages of the positive-polarity picture signal-generating circuit 54 include a highest voltage+$\alpha$ volt and a central voltage−$\alpha$ volt. In this embodiment, however, $\alpha$ is assumed to be 0 representing an ideal value for no circuit resistance, so that supply voltages of the negative-polarity picture signal-generating circuit 53 are set to VDD=4.5 volts and VSS=0 volt, and supply voltages of the positive-polarity picture signal-generating circuit 54 are set to VDD=9 volts and VSS=4.5 volts.

In this way, by setting the amplitudes of positive-polarity picture signals within range of a highest voltage (9 volts) and a central voltage (4.5 volts) between the highest voltage (9 volts) and a lowest voltage (0 volt) and setting the amplitudes of negative-polarity picture signals within a range of the lowest voltage (0 volt) and the central voltage (4.5 volts), the supply voltages can be reduced to nearly a half and the electricity consumption can be reduced to nearly a fourth, thus realizing a remarkable reduction.

In the above, an embodiment of a column inversion drive has been described, but a dot inversion drive can also be performed in the following manner. In a first frame, at the time of scanning odd-numbered scanning lines, the first transfer switches for the odd-numbered vertical signal lines and the second transfer switches for the even-numbered vertical signal lines are made conductive; and at the time of scanning even-numbered scanning lines, the second transfer switches for the odd-numbered vertical signal lines and the first transfer switches for the even-numbered vertical scanning lines are made conductive. Further, in a second frame, at the time of scanning odd-numbered scanning lines, the second transfer switches for the odd-numbered vertical signal lines and the first transfer switches for the even-numbered vertical signal lines are made conductive; and at the time of scanning even-numbered scanning lines, the first transfer switches for the odd-numbered vertical signal lines and the second transfer switches for the even-numbered vertical scanning lines are made conductive.

Figure 17:
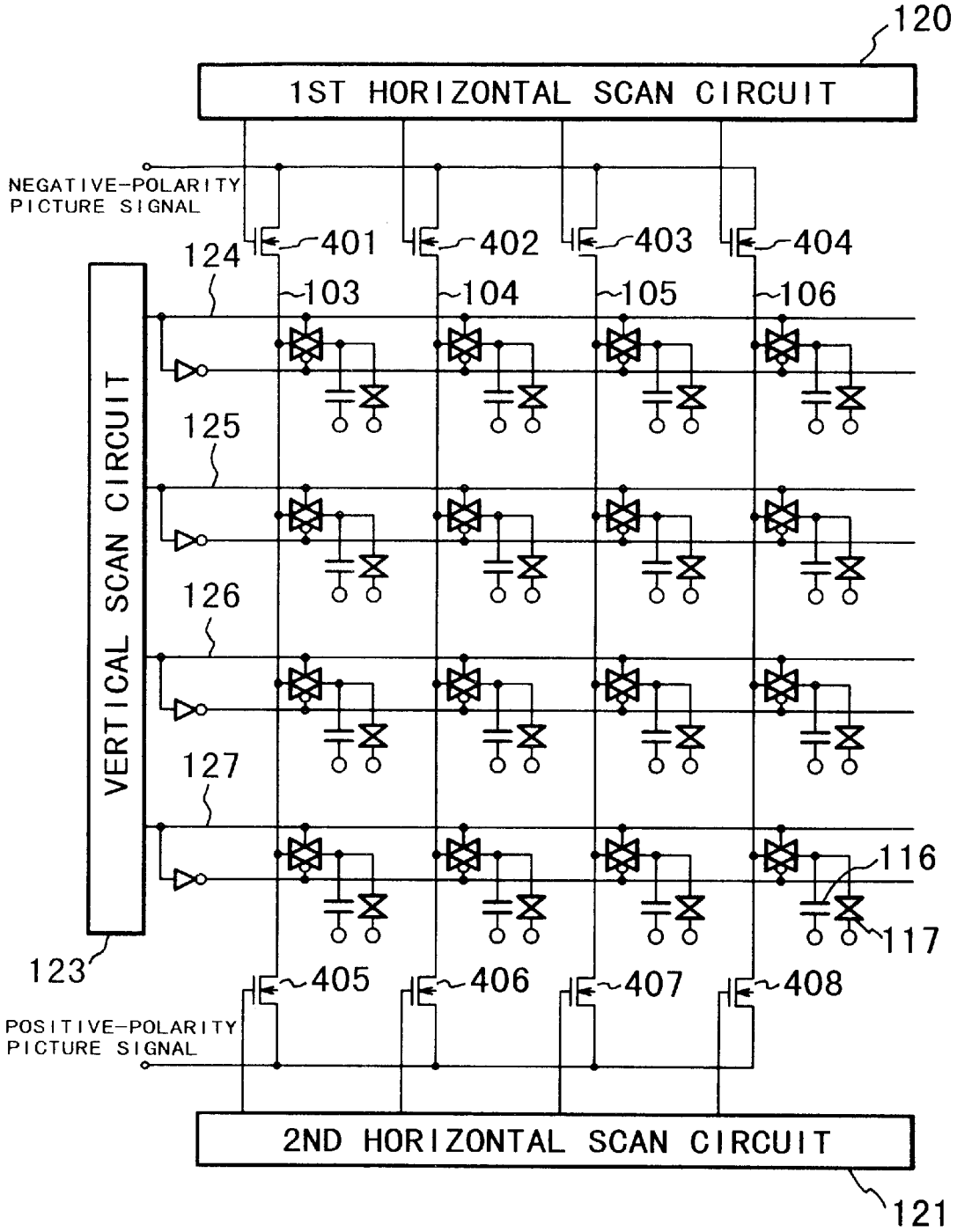
FIGS. 17 and 21 are respectively an equivalent circuit diagram of another display panel included in the display apparatus of FIG. 9.
Figure 18:
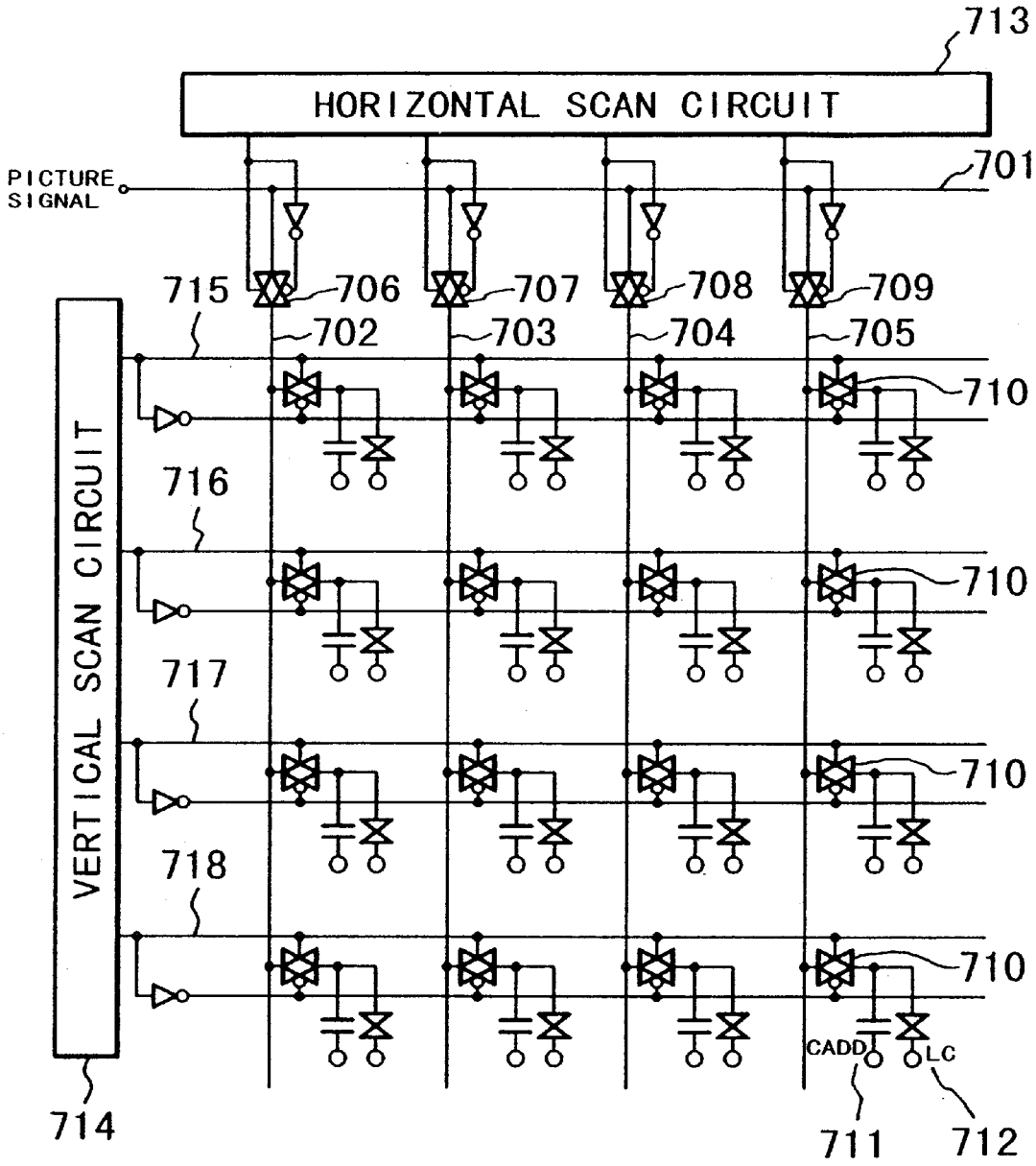
FIG. 18 PRIOR ART
FIGS. 18 and 20 are respectively an equivalent circuit diagram of a display panel included in a conventional liquid crystal display apparatus.
Figure 19:
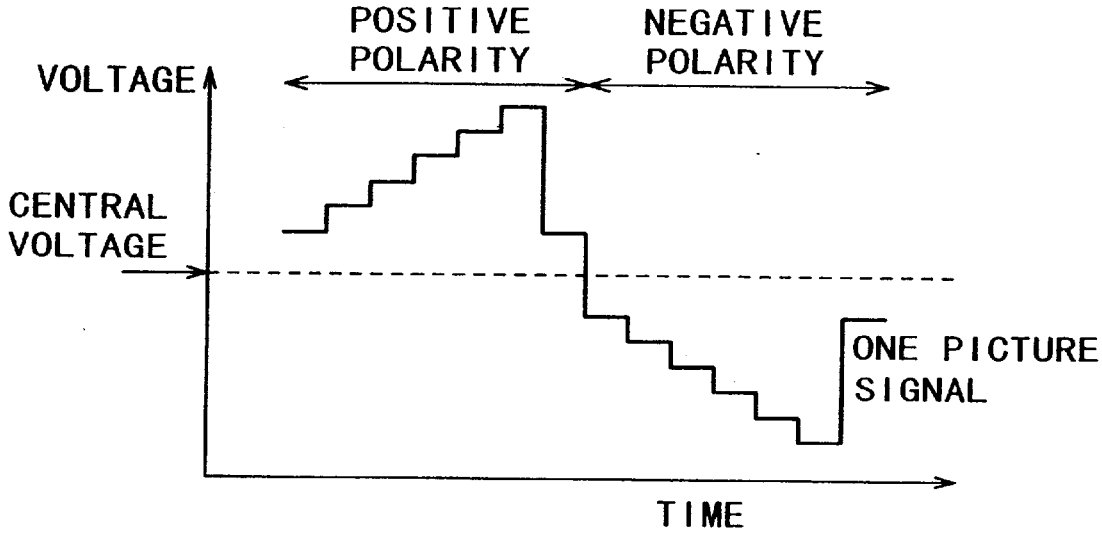
FIG. 19 PRIOR ART
FIG. 19 illustrates a bipolar drive signal for AC drive used in a conventional liquid crystal display apparatus.
Figure 20:
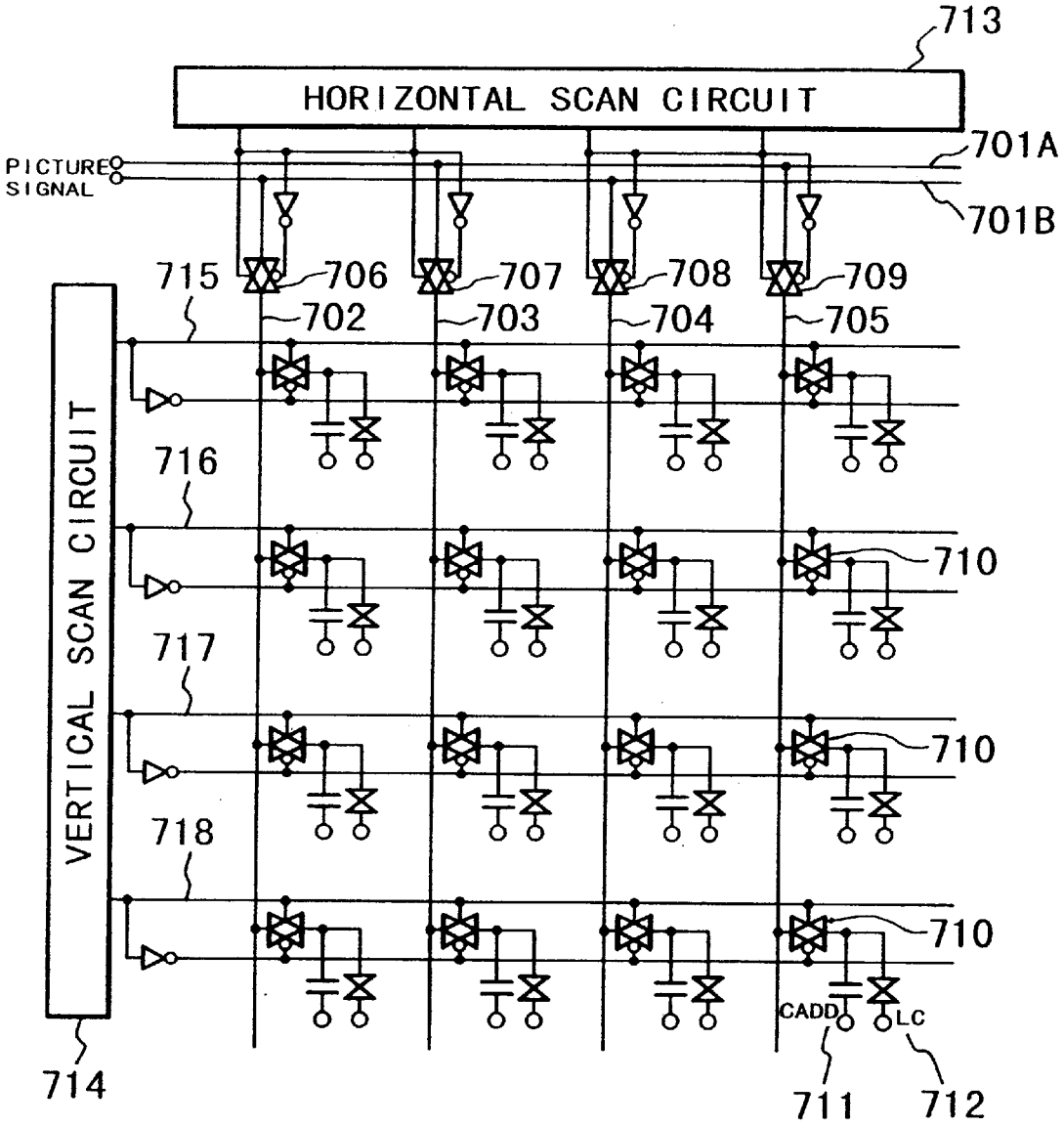
FIG. 20 PRIOR ART

FIG. 17 is an equivalent circuit diagram of a display panel 93 (FIG. 10) according to another embodiment of the liquid crystal display apparatus of the present invention. In FIG. 17, like parts are denoted by like numerals as in FIG. 11.

Referring to FIG. 17, the display panel includes n-channel-type transistors (first conductivity-type transistors) 401–404 used as transfer switches for negative-polarity picture signals, and p-channel-type transistors (second conductivity-type transistors) used as transfer switches for positive polarity picture signals.

In this case, as the first transfer switches are supplied with only negative-polarity voltages, the use of such n-channel-type transistors as the first transfer switches does not require a high source voltage resulting in a problematic substrate bias effect.

On the other hand, as the second transfer switches are supplied with only positive-polarity voltages, the use of p-channel-type transistors as the second transfer switches does not require a low source voltage resulting in a problematic substrate bias effect.

In this way, as the respective transfer switches can be composed of transistors of simple structure, so that the entire circuit size and layout area can be reduced.

Figure 21:
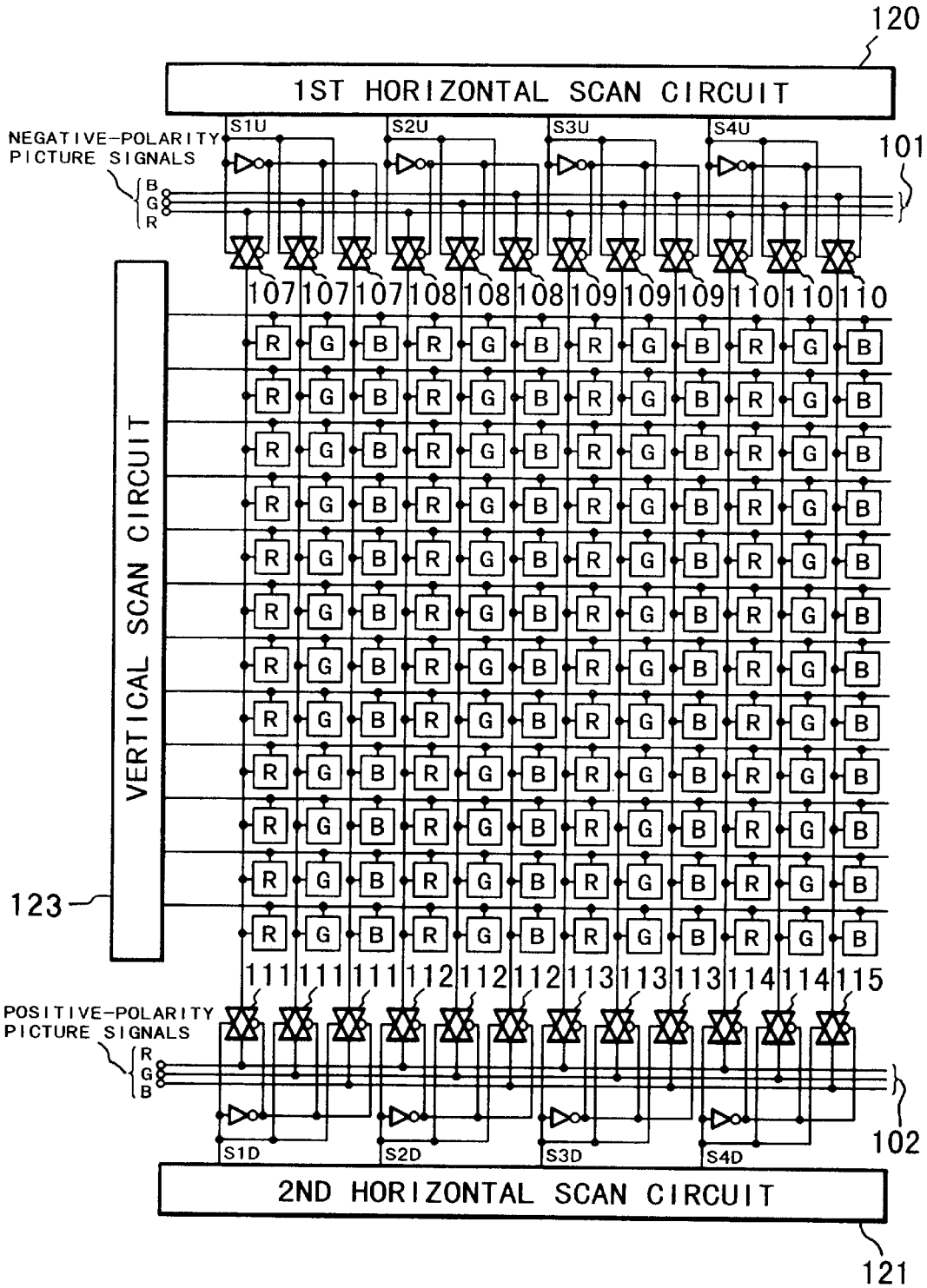

FIG. 21 is an equivalent circuit diagram of a display panel 93 (FIG. 10) according still another embodiment of the liquid crystal display apparatus of the present invention. In FIG. 21, like parts are denoted by like numerals as in FIG. 11.

Referring to FIG. 21, the display panel is a full-color display panel comprising three color pixels of R, G and B. In this embodiment, the transfer switches S1U–S4U and S1D–S4D are selected in the same manner as in the embodiment of FIG. 11, picture signals for R, G and B pixels in a unit are sampled by one selection of a transfer switch.

As a result, a column inversion drive can be realized by regarding three color columns of R, G and B as one color. Furthermore, it is also possible to effect a dot inversion drive (in an inversion pattern as represented by a checker pattern) similarly as described with reference to the embodiment of FIG. 11 by regarding a set of three color pixels of R, G and D as one pixel.

As described above, by supplying one-polarity picture signals to signal lines along odd-numbered columns and the other-polarity picture signals to signal lines along even-numbered columns in a first frame; and supplying the other-polarity picture signals to signal lines along odd-numbered columns and one-polarity picture signals to signal lines along even-numbered columns in a second frame, it becomes possible to reduce the electricity consumption and also reduce the circuit size of the display panel.

What is claimed is:

1. An electronic circuit, comprising a plurality of first D/A converters and at least one correction A/D converter unit, wherein each first D/A converter is provided with an offset memory means for memorizing offset correction digital data, and an operation means for adding or subtracting the offset correction digital data to a digital input signal to the D/A converter, and said correction A/D converter unit includes a comparative data generating circuit having a plurality of bits and sequentially outputting plural-bit data while changing the plural-bit data sequentially from its upper bits, an adder means for adding a digital input signal and an output from the comparative data-generating circuit, a second D/A converter for converting a digital output from the adder means into an analog signal, a comparator means for comparing the analog signal with an analog output from each first D/A converter, and an encoder means for generating offset correction digital data to be memorized in the offset memory means based on an output of the comparator means.

2. An electronic circuit according to claim 1, wherein each D/A converter has a capacity for receiving totally m bits larger than n bits of the digital input signal by at least one bit ($m-n \geqq 1$), so as to input lower L bits ($L \geqq 1$) of the offset correction digital data of k bits to lower L bits of the D/A converter and input a digital signal obtained by adding the n-bit digital input signal and upper (k−L) bits of the offset correction digital data to upper (m−L) bits of the D/A converter.

3. An electronic circuit according to claim 1, wherein each first D/A converter is provided with a reference voltage generating circuit capable of generating a plurality of successive levels of reference voltages, so that i-th and (i+2)-th levels of reference voltages among the successive levels of reference voltages are selected based on upper j bits of the n-bit digital input signal, and a voltage between the i-th and (i+2)-th reference voltages is further divided based on lower (n−j) bits of the n-bit digital input signal.

4. A liquid crystal display apparatus, comprising: an active matrix substrate having thereon a plurality of scanning lines, a plurality of signal lines and pixel electrodes each connected via a switch to an intersection of the scanning lines and the signal lines, a counter substrate disposed with a spacing from the active matrix, a liquid crystal sandwiched between the active matrix substrate and the counter substrate, and an electronic circuit according to claim 1 disposed so as to supply picture signals to the signal lines.

5. A liquid crystal display apparatus according to claim 4, wherein the electronic circuit is disposed on a common substrate with the active matrix substrate.

6. An electronic circuit, comprising:

a plurality of units each including a D/A converter for converting a digital signal into an analog signal, each D/A converter having an offset value peculiar thereto; and an offset value generation circuit, common to each of the plurality of units, for generating said offset value peculiar to the D/A converter in each unit, wherein said offset value generation circuit receives as an input, analog outputs of respective D/A converters via switches that are sequentially turned on, each of said plurality of units further comprising:

a memory for memorizing the offset value peculiar to the D/A converter in the unit as digital data; and an operation means for adding or subtracting the digital data read out from the memory to or from a digital input signal to provide a corrected digital signal, wherein the corrected digital signal is applied to the D/A converter which outputs the analog signal for which the offset value peculiar to the D/A converter has been corrected.

7. An electronic circuit according to claim 6, wherein each unit includes a decoder for decoding an upper bit of the digital input signal, and a selector for selecting a reference voltage supplied to the D/A converter based on an output of the decoder.

8. An electronic circuit according to claim 6, wherein the operation means in each unit operates a lower bit of the digital input signal and an upper bit of the digital data memorized in the memory.

9. An electronic circuit according to claim 6, wherein the D/A converter in each unit receives a reference voltage selected by decoding an upper bit of the digital input signal, the operated digital signal obtained by operating a lower bit of the digital input signal and an upper bit of the digital data memorized in the memory, and a lower bit of the digital data memorized in the memory.

10. An electronic circuit, comprising:

a plurality of units each including a D/A converter for converting a digital signal into an analog signal, each D/A converter having an offset value peculiar thereto, and each of the plurality of units also including a memory means for memorizing the offset value peculiar to the D/A converter in the unit as digital data, and an operation means; and an offset value generation circuit for generating said offset value peculiar to the D/A converter in each unit, said offset value generation circuit including:

a second operation means;

a second D/A converter;

a comparator for comparing an output of the D/A converter in each unit and an output of the second D/A converter, wherein the comparator receives as an input, analog outputs of respective D/A converters via switches that are sequentially turned on; and an encoder for generating the digital data to be memorized in the memory means based on an output of the comparator, wherein the operation means of each said plurality of units is for adding or subtracting the digital data read out from the memory means to or from a digital input signal to provide a corrected digital signal, wherein the corrected digital signal is applied to the D/A converter which outputs the analog signal for which the offset value peculiar to the D/A converter has been corrected.

11. An electronic circuit according to claim 10, wherein said offset value generation circuit includes a decoder for decoding an upper bit of the digital input signal, and a selector for selecting a reference voltage supplied to the second D/A converter based on an output of the decoder.

12. An electronic circuit according to claim 10, wherein said second operation means operates a lower bit of the digital input signal and an upper bit of the digital data stored in a comparative data generator.

13. An electronic circuit according to claim 10, wherein the second D/A converter receives a reference voltage selected by decoding an upper bit of the digital input signal, an operated data obtained by operating a lower bit of the digital input signal and an upper bit of a comparative data generator, and a lower bit of the digital data stored in the comparative data generator.

14. A display apparatus, comprising an electronic circuit according to any one of claims 6 to 13, and an active matrix circuit substrate connected to the electronic circuit.

* * * * *

UNITED STATES PATENT AND TRADEMARK OFFICE

CERTIFICATE OF CORRECTION

PATENT NO. : 6,670,938 B1
DATED : December 30, 2003
INVENTOR(S) : Daisuke Yoshida It is certified that error appears in the above-identified patent and that said Letters Patent is hereby corrected as shown below:

Drawings,
Sheet 11, Figure 12, "POSITEVE PICTURE" should read -- POSITIVE PICTURE --; and "EVEN COLUMN PICTURE SIGNA" should read -- EVEN COLUMN PICTURE SIGNAL --.

Column1,
Line 41, "liens" should read -- lines --.

Column 3,
Line 9, "D/a" should read -- D/A --; and
Line 47, "in" (second occurrence) should be deleted.

Column 5,
Line 34, "is are" should read -- are --; and
Line 37, "ignal" sholud read -- signal --.

Column 6,
Line 30, "10 levels reference" should read -- 10 levels of reference --.

Column 9,
Line 28, "connected one" should read -- connected to one --.

Column 11,
Line 36, "wit a " should read -- with a --.

UNITED STATES PATENT AND TRADEMARK OFFICE

CERTIFICATE OF CORRECTION

PATENT NO. : 6,670,938 B1
DATED : December 30, 2003
INVENTOR(S) : Daisuke Yoshida It is certified that error appears in the above-identified patent and that said Letters Patent is hereby corrected as shown below:

Column 12,
Line 37, "according still" should read -- according to still --; and
Line 52, "D as" should read -- B as --.

Signed and Sealed this

Third Day of August, 2004

JON W. DUDAS
*Acting Director of the United States Patent and Trademark Office*